US010765900B2

(12) United States Patent
Lacey

(10) Patent No.: US 10,765,900 B2
(45) Date of Patent: Sep. 8, 2020

(54) WEIGHTS SYSTEM

(71) Applicant: Flak Limited, Maldon Essex (GB)

(72) Inventor: Raymond Lacey, Maldon Essex (GB)

(73) Assignee: Flak Limited, Maldon Essex (GB)

( * ) Notice: Subject to any disclaimer, the term of this patent is extended or adjusted under 35 U.S.C. 154(b) by 109 days.

(21) Appl. No.: 15/756,063

(22) PCT Filed: Aug. 4, 2016

(86) PCT No.: PCT/GB2016/052396
§ 371 (c)(1),
(2) Date: Feb. 28, 2018

(87) PCT Pub. No.: WO2017/037411
PCT Pub. Date: Mar. 9, 2017

(65) Prior Publication Data

US 2018/0243599 A1 Aug. 30, 2018

(30) Foreign Application Priority Data

Aug. 28, 2015 (GB) ..... 1515323.2

(51) Int. Cl.
*A63B 21/00* (2006.01)
*A63B 24/00* (2006.01)
(Continued)

(52) U.S. Cl.
CPC .... *A63B 21/00076* (2013.01); *A63B 21/0058* (2013.01); *A63B 21/00069* (2013.01);
(Continued)

(58) Field of Classification Search
CPC ..... A63B 21/00076; A63B 21/062; A63B 21/0624–0632; A63B 21/0058; A63B 21/153–156; A63B 24/0087–2024/0096
See application file for complete search history.

(56) References Cited

U.S. PATENT DOCUMENTS 5,328,429 A 7/1994 Potash et al.
5,697,869 A * 12/1997 Ehrenfried ..... A63B 21/0058 482/129
(Continued)

FOREIGN PATENT DOCUMENTS

WO 1988007393 A1 10/1988
WO 1994027679 A1 12/1994
(Continued)

*Primary Examiner* — Jennifer Robertson

(57) ABSTRACT

A system for imparting a variable user force to a user, the system comprising: a line guide arrangement, including at least one moveable line guide which may move in both directions along a linear axis; wherein a force arrangement is arranged to apply at least one internal force to the at least one moveable line guide, wherein the at least one internal force opposes the motion of the at least one moveable line guide in a first direction along the linear axis; a member with which the user may interact so that the user force is applied to the user through the member; a line, having a distal end and a proximal end, with the distal end of the line attached to the member, the line being continuously threaded around the line guide arrangement; the system further comprising a line adjustment arrangement, wherein: the line adjustment arrangement is attached to the line, or is connected to move a component of the line guide arrangement; when the line adjustment arrangement is in a locked mode, there is a first ratio between distance moved by the member and distance moved by the force arrangement; and the line adjustment arrangement is operable to remove/introduce line between an entry point and the member, or actively move the component of the line guide arrangement, to alter the ratio between distance moved by the member and distance moved by the force arrangement during movement of the member.

19 Claims, 8 Drawing Sheets

Figure 1:
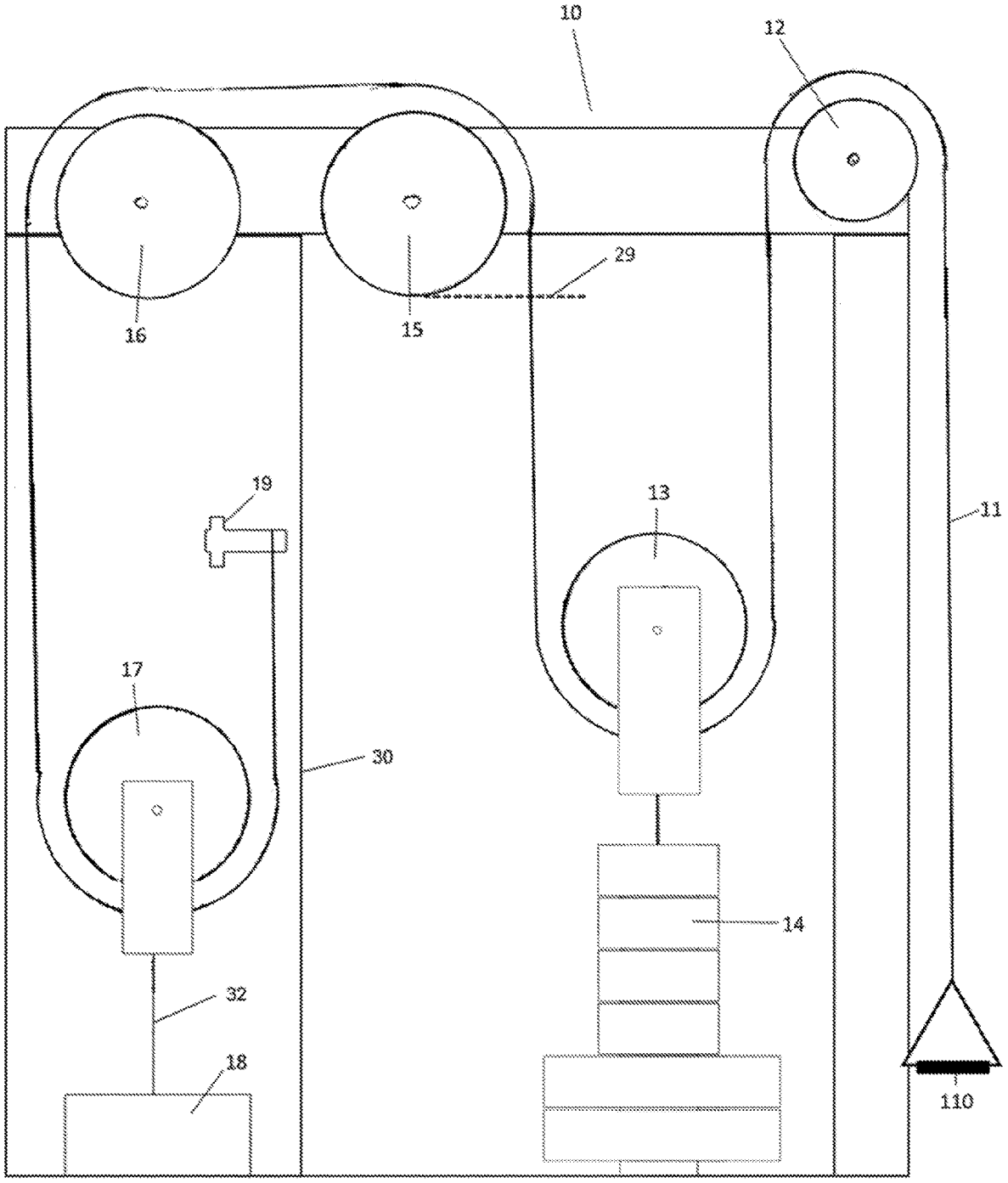

(51) Int. Cl.

| | |
|---|---|
| ***A63B 21/062*** | (2006.01) |
| ***A63B 21/005*** | (2006.01) |
| ***A63B 71/06*** | (2006.01) |
| ***A63B 21/055*** | (2006.01) |
| ***A63B 71/00*** | (2006.01) |

(52) U.S. Cl.

CPC ..... *A63B 21/0628* (2015.10); *A63B 21/153* (2013.01); *A63B 21/154* (2013.01); *A63B 21/156* (2013.01); *A63B 21/4035* (2015.10); *A63B 24/0087* (2013.01); *A63B 21/0552* (2013.01); *A63B 71/0622* (2013.01); *A63B 2071/0081* (2013.01); *A63B 2071/068* (2013.01); *A63B 2220/20* (2013.01); *A63B 2220/803* (2013.01); *A63B 2220/805* (2013.01); *A63B 2220/808* (2013.01); *A63B 2225/093* (2013.01); *A63B 2225/50* (2013.01); *A63B 2225/54* (2013.01)

(56) References Cited

U.S. PATENT DOCUMENTS

| | | | | |
|---|---|---|---|---|
| 5,738,611 | A * | 4/1998 | Ehrenfried | A63B 21/023 482/129 |
| 6,413,195 | B1 * | 7/2002 | Barzelay | A63B 21/00178 482/112 |
| 6,770,015 | B2 * | 8/2004 | Simonson | A63B 21/154 482/101 |
| 7,172,538 | B2 * | 2/2007 | Keiser | A63B 21/0087 482/140 |
| 8,172,733 | B1 * | 5/2012 | Batca | A63B 21/156 482/93 |
| 10,265,572 | B2 * | 4/2019 | Bach | A63B 21/0087 |
| 2009/0170668 | A1 * | 7/2009 | Giannelli | A63B 21/4043 482/94 |
| 2010/0267527 | A1 * | 10/2010 | Luquette | A63B 21/0552 482/94 |
| 2013/0274075 | A1 * | 10/2013 | Habing | A63B 21/00065 482/102 |
| 2014/0038777 | A1 * | 2/2014 | Bird | A63B 21/151 482/5 |
| 2014/0121071 | A1 * | 5/2014 | Strom | A63B 21/156 482/99 |
| 2016/0121156 | A1 * | 5/2016 | Bach | A63B 21/0087 482/112 |
| 2017/0173379 | A1 * | 6/2017 | Bach | A63B 21/4011 |
| 2017/0173380 | A1 * | 6/2017 | Bach | A63B 71/0619 |
| 2017/0173396 | A1 * | 6/2017 | Lu | A63B 24/0087 |
| 2017/0197103 | A1 * | 7/2017 | Rau | A63B 21/063 |
| 2018/0154209 | A1 * | 6/2018 | Watterson | A63B 21/00192 |
| 2019/0099637 | A1 * | 4/2019 | Valente | A63B 21/0058 |
| 2019/0099652 | A1 * | 4/2019 | Orady | A63B 21/4043 |
| 2019/0262652 | A1 * | 8/2019 | Orady | A63B 21/4043 |

FOREIGN PATENT DOCUMENTS

| | | | |
|---|---|---|---|
| WO | 2013009749 | A1 | 1/2013 |
| WO | 2013044292 | A1 | 4/2013 |
| WO | 2015042215 | A1 | 3/2015 |

* cited by examiner

WEIGHTS SYSTEM

DESCRIPTION OF INVENTION

This invention relates to a system of pulleys and weights, and in particular a system which delivers a variable amount of force to a user.

In order to improve strength and fitness, many people lift weights. When lifting weights a user may simply perform repetitions with free weights, or a user may perform repetitions with one of a myriad of different exercise machines in order to target one or more specific muscle groups. Exercise machines have an advantage over free weights in that they allow a user to perform weight lifting in a more safe, efficient and versatile manner. Typically, exercise machines allow users to perform repetitions against a constant resistance, which may operate via a cam mechanism that is fixed at the time of manufacture and is not modifiable by the user.

However, it recognised in the art that many users do not want to perform repetitions on exercise machines that provides a constant resistance throughout the repetition. It is advantageous for a user to be able to perform repetitions where the resistance provided by the exercise machine can vary throughout the repetition. This may be desirable, for instance, because a typical user is able to lower a much greater load than they can raise in a controlled manner.

Exercise machines that allow a user to vary the resistance applied throughout a repetition exist in the art. However, these machines are often oversized and complicated.

U.S. Pat. No. 5,356,360 discloses an exercise machine that uses a variable resistance cam to impart a variable resistance to a user performing a repetition.

Another example of an exercise machine known in the art is disclosed in EP 2316538. The exercise machine comprises a weight stack mounted within a moveable frame. The frame can pivot about its lower end so that its angle with respect to the vertical can be altered, such that the force imparted to a user may be varied during a repetition.

It is desirable to have an exercise machine that allows a user to vary the resistance applied throughout a repetition, but is not oversized or complicated when compared to an exercise machine that provides a constant resistance.

The present invention aims to address at least some of these problems.

The present invention relates to a system for imparting a variable user force to a user, the system comprising: a line guide arrangement, including at least one moveable line guide which may move in both directions along a linear axis; wherein a force arrangement is arranged to apply at least one internal force to the at least one moveable line guide, wherein the at least one internal force opposes the motion of the at least one moveable line guide in a first direction along the linear axis; a member with which the user may interact so that the user force is applied to the user through the member; a line, having a distal end and a proximal end, with the distal end of the line attached to the member, the line being continuously threaded around the line guide arrangement; the system further comprising a line adjustment arrangement, wherein: the line adjustment arrangement is attached to the line, or is connected to move a component of the line guide arrangement; when the line adjustment arrangement is in a locked mode, there is a first ratio between distance moved by the member and distance moved by the force arrangement; and the line adjustment arrangement is operable to remove/introduce line between an entry point and the member, or actively move the component of the line guide arrangement, to alter the ratio between distance moved by the member and distance moved by the force arrangement during movement of the member.

Preferably, the user force is proportional to the internal force and the user force may be varied by manipulating the line adjustment arrangement.

Preferably, the user performs a first motion when the member is moved in a first direction and performs a second motion when the member is moved in a second direction.

Preferably, the system is configured to apply a first mode of operation during the first motion and a second mode of operation during the second motion, wherein the line adjustment arrangement changes the length of line between the entry point and the member is in a different manner during the first and second modes of operation.

Preferably, the first or second mode of operation is such that the first or second motion may be performed without any active change in the length of the line between the entry point and the member being applied by the line adjustment arrangement.

Preferably, the system is configured to apply a third mode of operation when the member is stationary between the first and second motions, wherein the line adjustment arrangement changes the length of line between the entry point and the member.

Preferably, the system is configured to apply a fourth mode of operation when the member is stationary between the second motion and a further first motion, wherein the line adjustment arrangement changes the length of line between the entry point and the member.

Preferably, the third and/or fourth modes are configured such that, following the first and the second motions, the length of line in the system is the same as before the first motion.

Preferably, the line adjustment arrangement is able to adjust the length of the line in the system in a continuous manner.

Preferably, the line adjustment arrangement is able to adjust the length of the line in the system in a step-wise manner.

Preferably, in use, the internal force is applied by a mass within a gravitational field.

Preferably, in use, the internal force is applied by a rotor in an electromagnetic field.

Preferably, in use, the internal force is applied by the deformation of an elastic object.

Preferably, the line is a cable.

Preferably, the line is a belt.

Preferably, the line adjustment arrangement comprises a motorised spool or a winch.

Preferably, the line adjustment arrangement comprises a linear actuator.

Preferably, the line adjustment arrangement can be manipulated by the user, a third party, or both the user and the third party to change the length of line between the entry point and the member.

Preferably, the line adjustment arrangement can be manipulated through voice recognition to change the length of line between the entry point and the member.

Preferably, the line adjustment arrangement can be manipulated with a switch to change the length of line between the entry point and the member.

Preferably, the line adjustment arrangement can be manipulated through eye movement recognition to change the length of line between the entry point and the member.

Preferably, the system further comprises a measurement arrangement to measure movement of the member.

Preferably, the manipulation of the line adjustment arrangement is automated by a real-time system, the real-time system able to process at least the user force, the internal force and the length of line between the entry point and the member using a microprocessor.

Preferably, the manipulation of the line adjustment arrangement is automated by a real-time system, the real-time system able to process at least the user force, the internal force and the length line between the entry point and the member by mechanical means.

Preferably, the system is an exercise device.

The invention also provides a system for imparting a variable user force to a user according to any of the above.

The present invention may also relate to a system for imparting a variable movement force to an object or a user, the system comprising: a line guide arrangement, including a moveable line guide which may move in both directions along a linear axis; a force generator configured to apply a linear force to the moveable line guide, wherein the movement force moves the moveable line guide in a first direction along the linear axis or opposes the movement of the moveable line guide in a second direction along the linear axis; wherein the object or user is arranged to apply an object force to the moveable line guide, wherein the object force opposes the motion of the moveable line guide in the first direction along the linear axis or moves the moveable line guide in a second direction along the linear axis; a first line, which is coupled with the force generator and having an end attached to the line guide arrangement, so that the force generator can apply the linear force to the moveable line guide through the first line, and a second line, having a distal end and a proximal end, the second line being threaded around the moveable line guide, the distal end of the second line being attached to a line adjustment arrangement and the proximal end of the second line attached to a fixed point, wherein the line adjustment arrangement is operable to change actively the length of the second line such that the object or a user may move in the first direction or the second direction at a rate that is different to the rate of movement of the moveable line guide.

Preferably, the force generator comprises a motorised pulley.

Preferably, the object force is at least partially offset by a counterweight.

Preferably, the system is a lift mechanism.

The invention also provides a system for imparting a variable user force to an object or a user according to any of the above.

Figure 2:
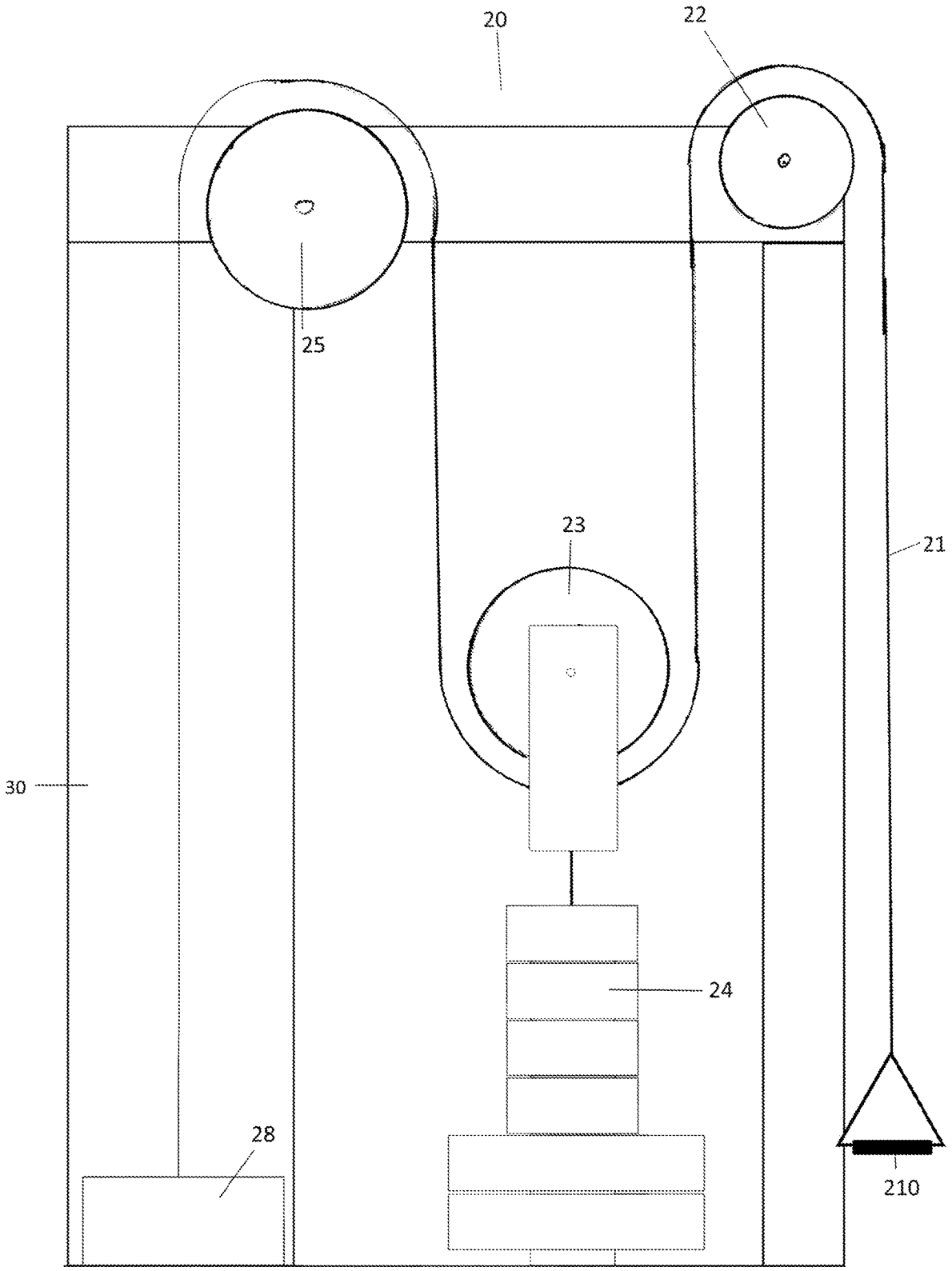
Figure 3:
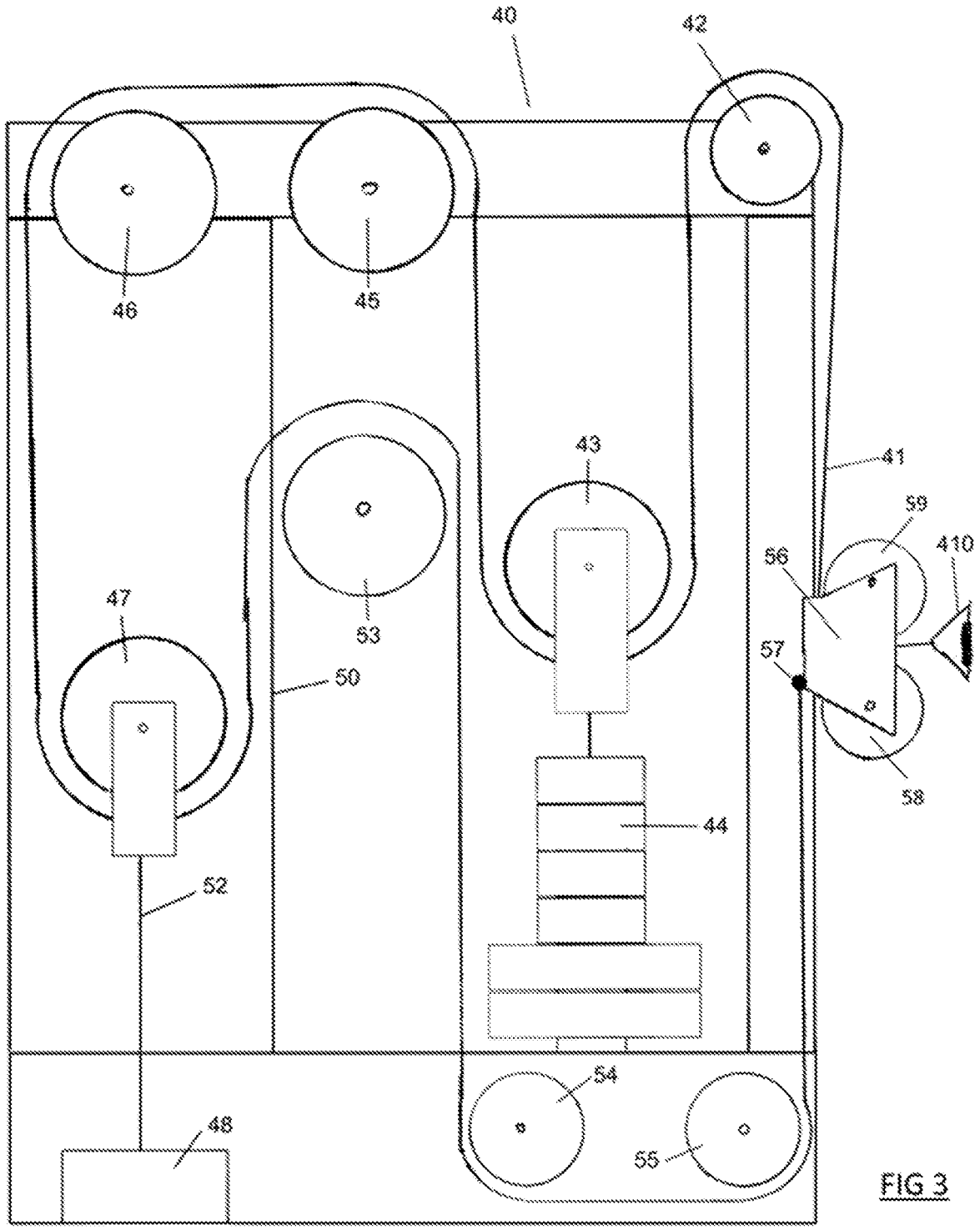
Figure 4:
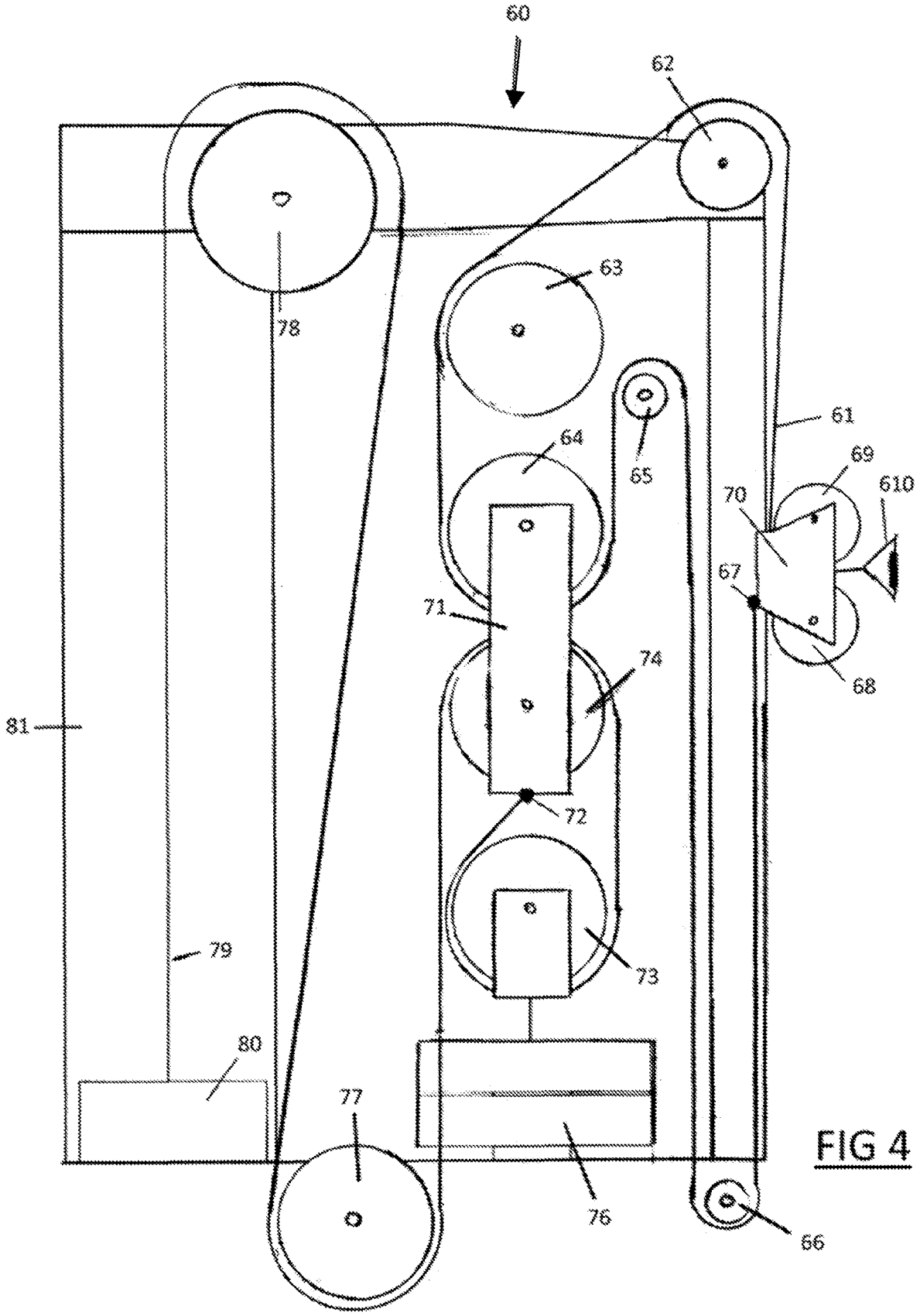
Figure 5:
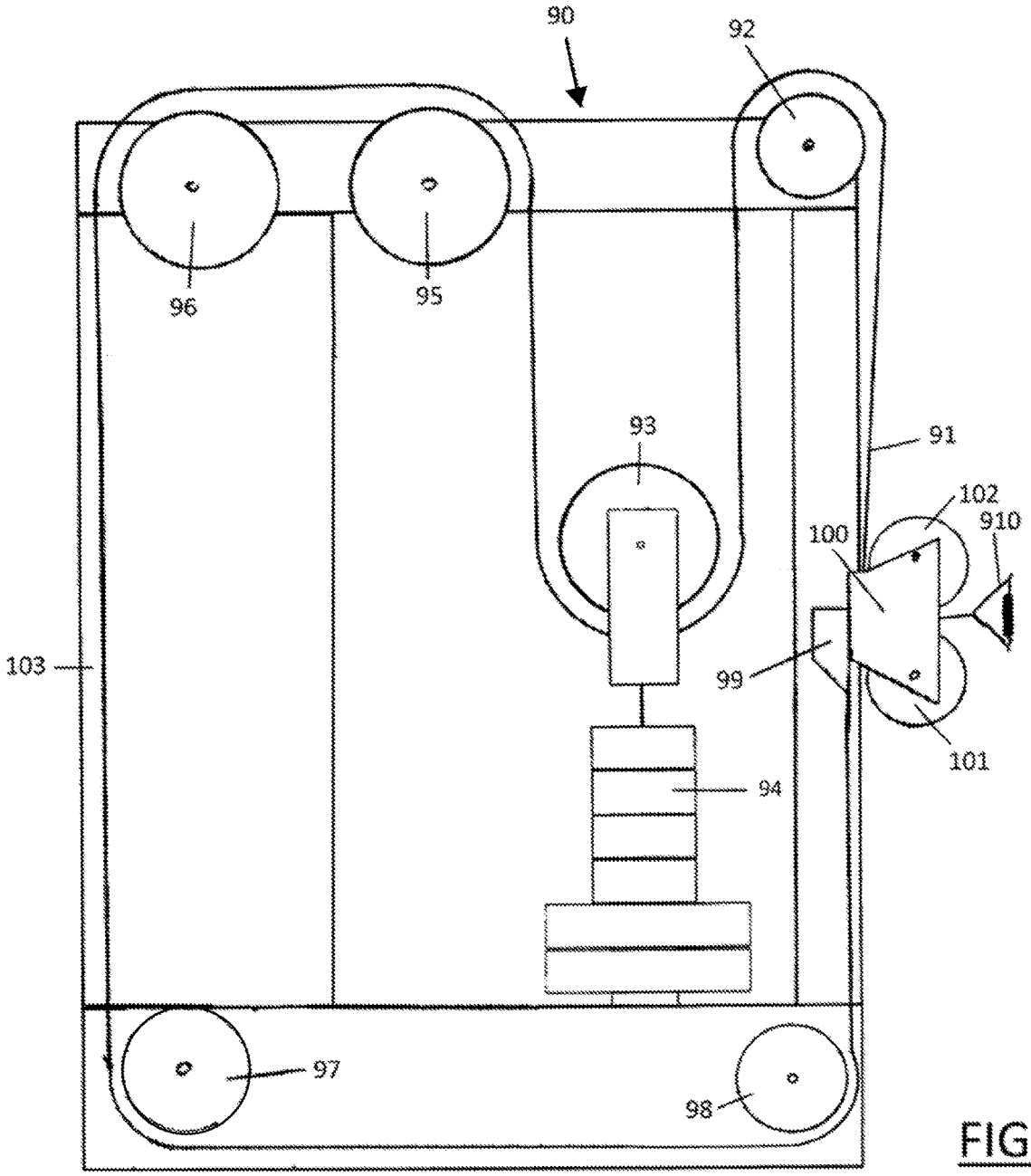
Figure 6:
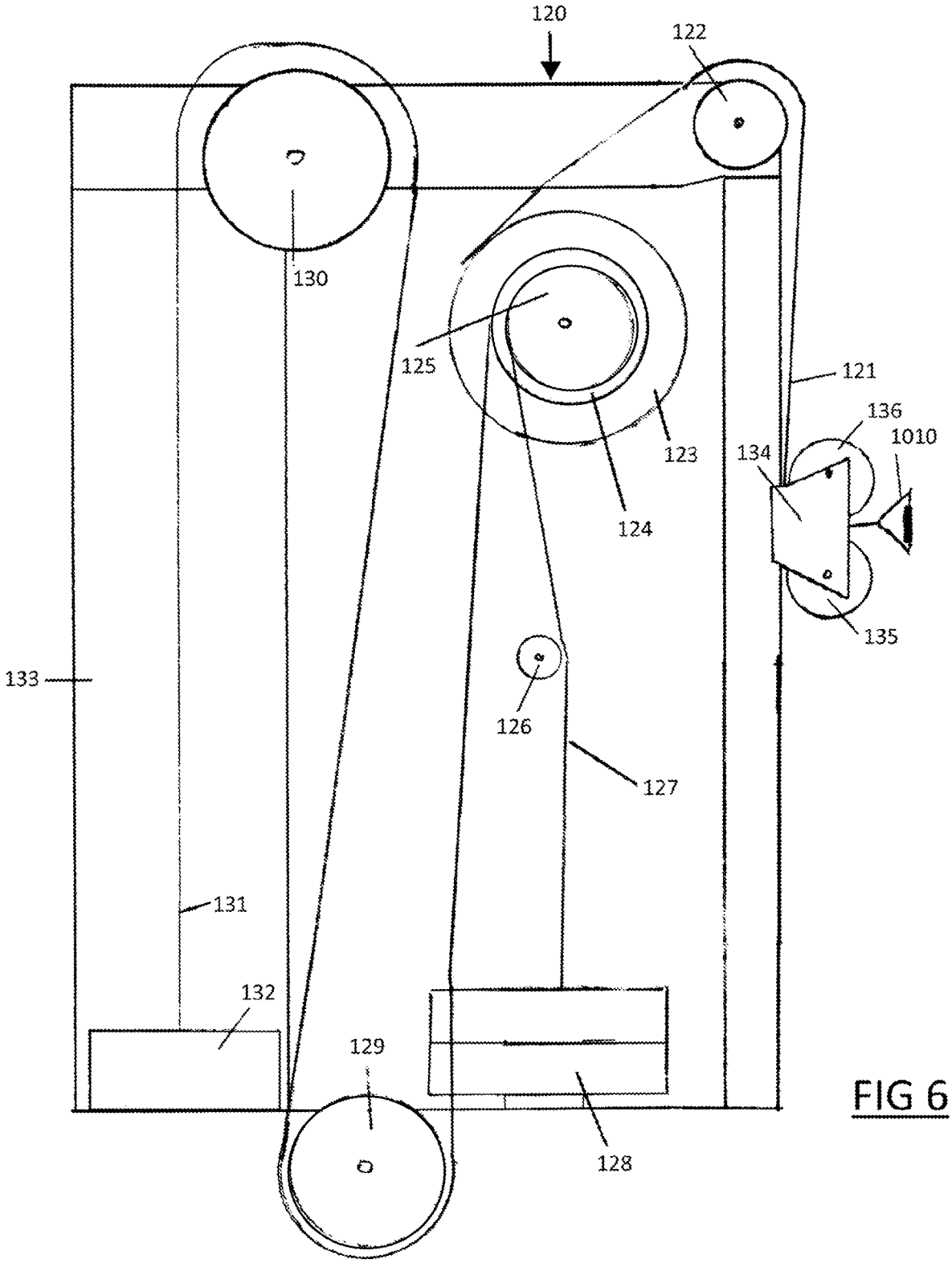
Figure 7:
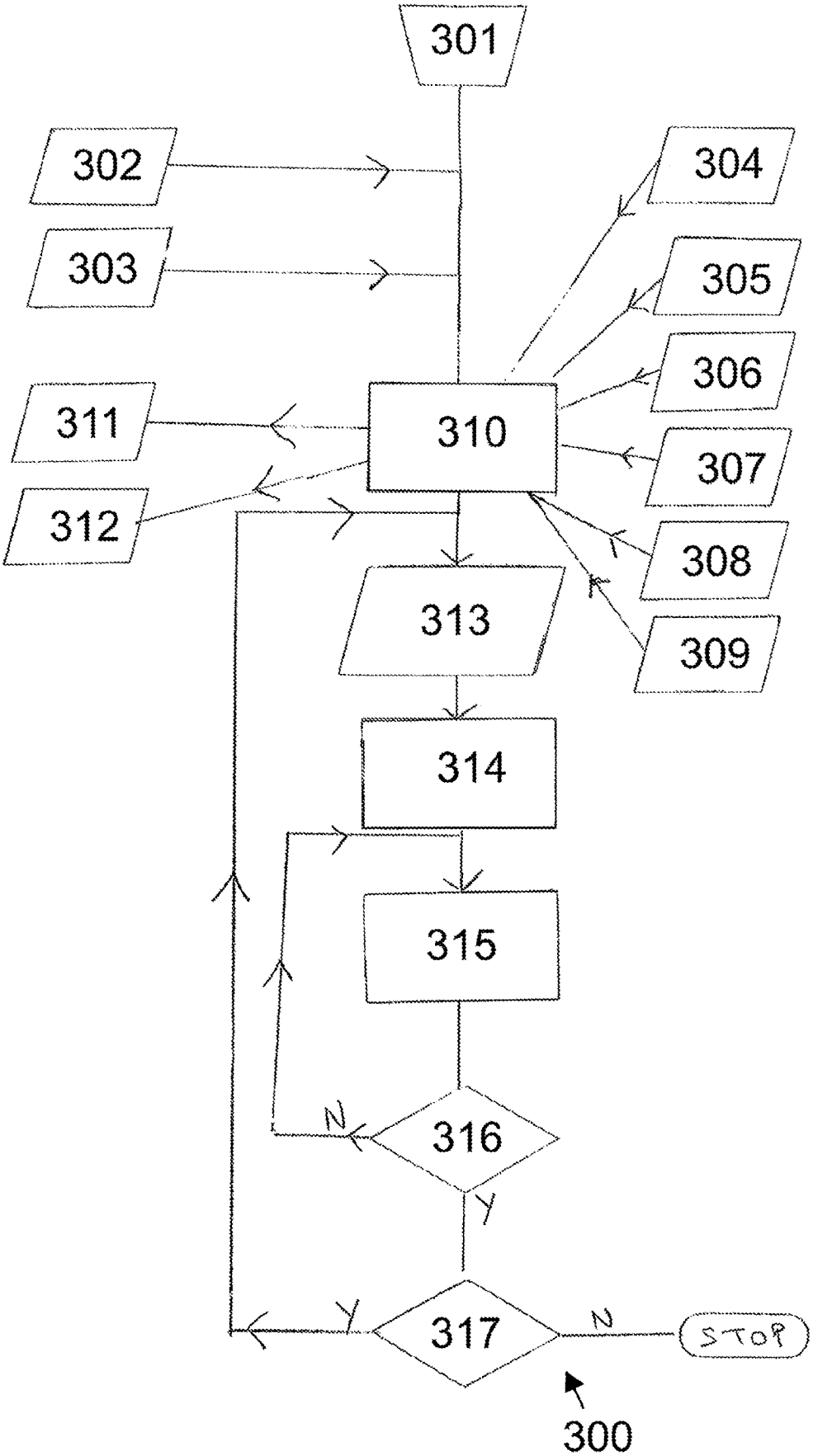
Figure 8:
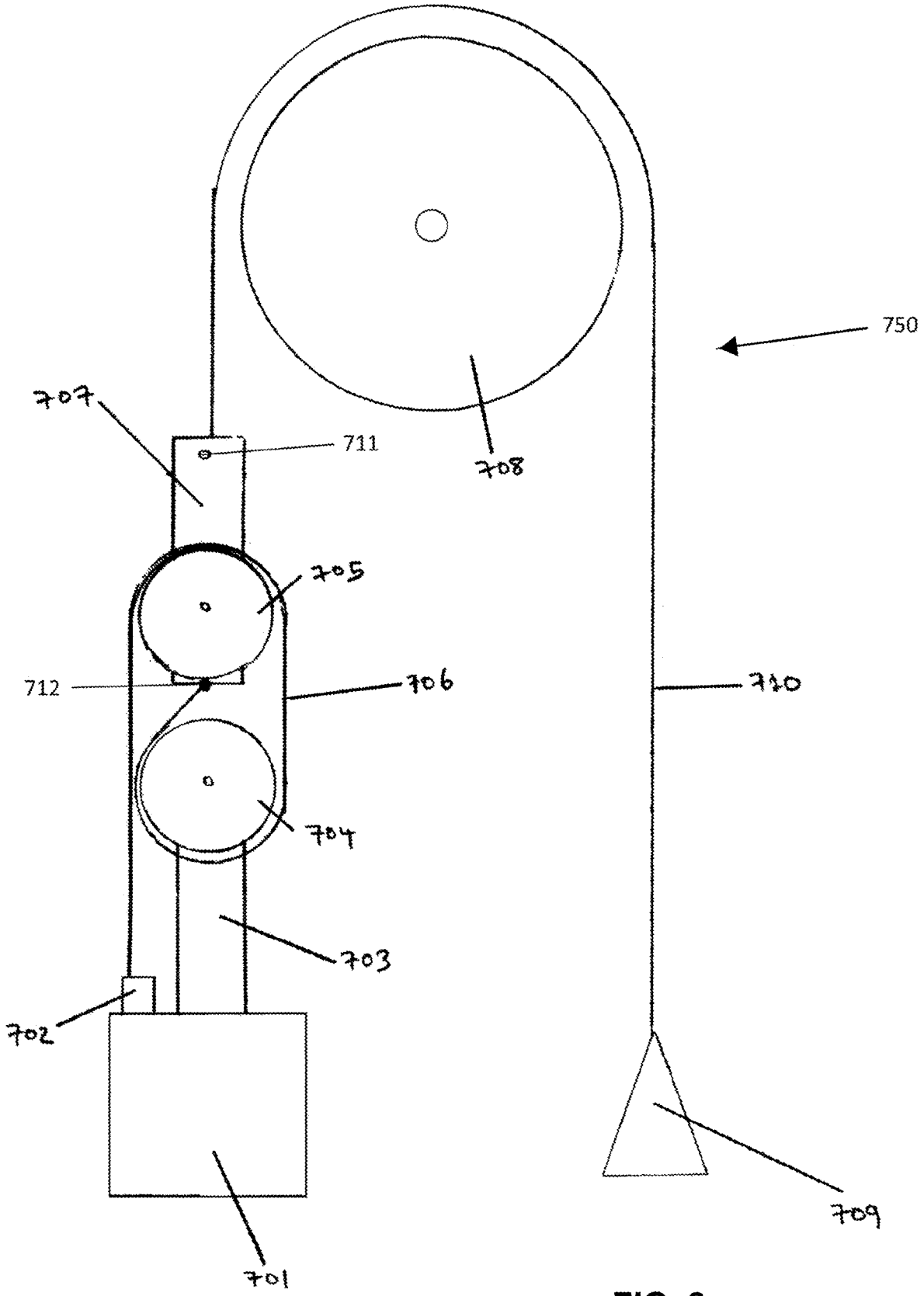

In order that the present invention may be more readily understood, embodiments thereof will now be described, by way of example, with reference to the accompanying drawings, in which:

FIG. 1 is a schematic view of a system for imparting a variable user force to a user according to an embodiment of the present invention; and FIG. 2 is a schematic view of a system for imparting a variable user force to a user according to another embodiment of the present invention; and FIG. 3 is a schematic view of a system for imparting a variable user force to a user according to another embodiment of the present invention; and FIG. 4 is a schematic view of a system for imparting a variable user force to a user according to another embodiment of the present invention; and FIG. 5 is a schematic view of a system for imparting a variable user force to a user according to another embodiment of the present invention; and FIG. 6 is a schematic view of a system for imparting a variable user force to a user according to another embodiment of the present invention; and FIG. 7 is a flow diagram showing the steps of imparting a variable user force to a user according to another embodiment of the present invention; and FIG. 8 is a schematic view of a system for imparting a variable user force to an object according to another embodiment of the present invention.

The embodiment shown in FIG. 1 comprises a first exercise machine 10 (only part of which is shown). The exercise machine 10 comprises a cable 11, a first pulley 12, a second pulley 13, a third pulley 15, a fourth pulley 16 and a fifth pulley 17. These components are held in place by a frame 30, which may take any suitable form. The cable 11 has a distal end attached to a handle 110. In use, the user can grasp the handle 110 to perform an exercise. The cable 11 extends upwards from the distal end to pass over the first pulley 12, which is preferably arranged at about head height. The first pulley 12 is vertically orientated and is rotatable about a first axis. The cable 11 extends downwards from the first pulley 12, to pass under the second pulley 13, which is preferably arranged at about waist height. The second pulley 13 is vertically orientated, is rotatable about a second axis and can move in both directions along a first, generally vertical linear axis. The second pulley 13 may be arranged to move along a vertical track (not shown), for example, to allow this motion to take place.

The cable 11 extends upwards from the second pulley 13 to pass over the third pulley 15, which is preferably arranged at a similar height to the first pulley 12. The third pulley 15 is vertically orientated and is rotatable about a third axis. The cable 11 extends away from the third pulley 15, in a generally horizontal direction that is away from the first pulley 12 and the second pulley 13, such that about a quarter of the surface of the third pulley 15 is in contact with the cable 11, to pass over the fourth pulley 16, which is preferably arranged at a similar height to the first pulley 12 and the third pulley 15. The fourth pulley 16 is vertically orientated and is rotatable around a fourth axis. The cable 11 extends downwards from the fourth pulley 16, to pass under the fifth pulley 17, which is preferably arranged at about waist height. The fifth pulley 17 is vertically orientated, is rotatable about a fifth axis and can move in both directions along a second linear axis. Once again, the fifth pulley 17 may slide along a vertical track during this motion.

The cable 11 extends upwards from the fifth pulley 17, with the proximal end of the cable 11 being attached to a bolt 19. The bolt 19 is attached to the frame 30 of the exercise machine 10. In another embodiment of the present invention, the bolt 19 is not present and the end of the cable 11 is welded directly to the frame 30 of the exercise machine. The cable 11 is continuously threaded around the first pulley 12, the second pulley 13, the third pulley 15, the fourth pulley 16 and the fifth pulley 17. A weight stack 14 is attached to the second pulley 13 and applies an internal force, in a first (i.e. downward) direction due to gravity, to the second pulley 13. The weight stack 14 may be arranged to move along a vertical track (not shown), for example, to allow the weight stack to move in both directions along a first, generally vertical linear axis.

A user force is applied by a user through the handle 110. In practice, a user pulls the handle 110 to lift the weight stack 14. The user exerts a force on the handle 110 in order to lift the weight stack 14 and in doing so, the handle 110 exerts an equal and opposite force on the user. In practice, the user will pull the handle 110 down to raise the weight stack 14 against gravity, and will then allow the handle 110 to rise, to lower the weight stack 14 again to complete one repetition of an exercise.

The exercise machine 10 further includes a second cable 32, which (in this example) is entirely separate from the cable 11 discussed above. The second cable 32 is attached at a distal end to a winch 18 and is attached at a proximal end to the fifth pulley 17. The winch 18 may be operated to rotate a drum (not shown) around which the second cable 32 is wound. The winch 18 may therefore increase or decrease the length of the second cable 32 that extends from the winch 18. The winch 18 is placed generally below the fifth pulley 17. The fifth pulley 17 has a sprung mechanism (not shown), which biases the fifth pulley 17 upwards and provides tension in the cable between the winch 18 and the fifth pulley 17. When the amount of cable between the winch 18 and the fifth pulley 17 is increased, the fifth pulley 17 moves in an upwards direction, away from the winch 18. When the amount of cable between the winch 18 and the fifth pulley 17 is decreased, the fifth pulley 17 moves in a downwards direction towards the winch 18.

The third pulley 15 may comprise an entry point 29. The entry point 29 is indicated by a dotted line and need not be a physical feature of the embodiment. There is an initial length of cable 11 between the entry point 29 and the handle 110. By reducing the length of cable 32 between the winch 18 and the fifth pulley 17, the fifth pulley 17 moves in the downwards direction which (in the absence of any other motion) decreases the amount of cable 11 between the entry point 29 and the handle 110. By increasing the amount of cable between the winch 18 and the fifth pulley 17, the fifth pulley 17 moves in the upwards direction, which increases the amount of cable 11 between the entry point 29 and the handle 110. The second pulley 13 may (if the handle 110 is held still) be moved along the first linear axis in both directions by changing the amount of cable between the entry point 29 and the handle 110. Assuming that the handle 110 is kept at a constant position, when the amount of cable between the entry point 29 and the handle 110 is decreased by reducing the amount of cable between the winch 18 and the fifth pulley 17, the second pulley 13 will move in the upwards direction and when the amount of cable between the entry point 29 and the handle 110 is increased by increasing the amount of cable between the winch 18 and the fifth pulley 17, the second pulley 13 will move in the downwards direction.

It will be understood that a different entry point could have been chosen than the point 29 indicated on FIG. 1. In general, it is preferred that the entry point is fixed with respect to the frame of the exercise machine 10, and is also preferably a point or region through which the cable 11 passes during all phases of motion of the cable 11. The length of cable 11 between the entry point 29 and the handle 110 is influenced by activation of the winch 18 during use of the exercise machine 10 or by the user moving the handle 110 during use of the exercise machine.

If an entry point is to be selected, it is important that a continuous length of cable extends from the entry point to the handle 110 (or, in other embodiments, to a different member with which the user interacts, such as a foot plate), and that the introduction or removal of cable at the entry point will move the weight stack 14 upwards or downwards if all other components of the exercise machine 10 are held in a stationary position.

The arrangement of components shown in FIG. 1 is schematic, and in other examples the relative positions of the components may be different. It is also envisaged that machines embodying the present invention will have further support and/or shielding components, so that the machine is sturdy and moving parts are not exposed to users any more than necessary. These further components are not shown in the figures for purposes of clarity.

In use, the user interacts with the handle 110 and performs a first motion when the handle 110 is moved in a first direction and a second motion when the handle 110 is moved in a second direction, which will usually be generally opposite to the first direction. These movements may comprise a concentric user movement and an eccentric user movement. A concentric user movement is a movement where the user's muscle is contracting and an eccentric user movement is a movement where the user's muscle is extending.

When the user performs the first motion and moves the handle 110 through one unit of distance, the user will raise the weight by 0.5 units. The effective weight experienced by the user is one-half of the real weight of the weight stack 14.

The embodiment shown in FIG. 2 comprises a second exercise machine 20 (only part of which is shown). The exercise machine 20 comprises a cable 21, a first pulley 22, a second pulley 23 and a third pulley 25, again held in place by a frame 30, which may take any suitable form. The cable 21 has a distal end attached to a handle 210. In use, the user can grasp the handle 210 to perform an exercise. The cable 21 extends upwards from the distal end to pass over the first pulley 22, which is preferably arranged at about head height. The first pulley 22 is vertically orientated and is rotatable about a first axis. The cable 21 extends downwards from the first pulley 22, to pass under the second pulley 23, which is preferably arranged at about waist height. The second pulley 23 is vertically orientated, is rotatable about a second axis and (as before) can move in both directions along a first, generally vertical linear axis.

The cable 21 extends upwards from the second pulley 23 to pass over the third pulley 25, which is preferably arranged at a similar height to the first pulley 22. The third pulley 25 is vertically orientated and is rotatable about a third axis. The cable 21 extends downwards from the second pulley 23, with the proximal end of the cable 11 being attached to a winch 28. The cable 21 is continuously threaded around the first pulley 22, the second pulley 23 and the third pulley 25.

A weight stack 24 is attached to the second pulley 23 and applies an internal force, in a first (i.e. downward) direction due to gravity, to the moveable second pulley 23. The weight stack 24 may be arranged to move along a vertical track (not shown), for example, to allow the weight stack to move in both directions along a first, generally vertical linear axis. A user force is applied by a user through the handle 210. In practice, a user pulls a handle 210 to lift the weight stack 24. The user exerts a force on the handle 210 in order to lift the weight stack 24 and in doing so, the handle 210 exerts an equal and opposite force on the user. In practice, the user will pull the handle 210 down to raise the weight stack 24 against gravity, and then lower the weight stack 24 again to complete one repetition of an exercise.

Where the cable enters the winch 28 may comprise an entry point. There is an initial length of cable 21 between the entry point and the handle 210. The second pulley 23 may (if the handle 210 is held still) be moved along the first linear axis by changing the amount of cable between the entry point and the handle 210. Assuming that the handle 210 is kept at a constant position, when the amount of cable between the entry point and the handle 210 is decreased, the second pulley 23 will move in the upwards direction and when the amount of cable between the entry point and the handle 210 is increased, the second pulley 23 will move in the downwards direction.

A difference between the embodiment shown in FIG. 1 and the embodiment depicted in FIG. 2 is the arrangement of the winch 18, 28. The second cable 32 of FIG. 1, which is connected to the winch 18, is not directly connected to the handle 110. The arrangement of FIG. 1 is likely to provide a smoother change in effective cable length as the winch 18 is attached to a fifth pulley 17, and a lower amount of stress is put on the third pulley 15 when compared to the embodiment shown in FIG. 2. The embodiment shown in FIG. 2 has two fewer pulleys and as a result is a simpler and more cost efficient arrangement.

The embodiment shown in FIG. 3 comprises a third exercise machine 40 (only part of which is shown). The exercise machine 40 comprises a cable 41, and first to tenth pulleys 58, 59, 42, 43, 45, 46, 47, 53, 54 55. These components are held in place by a frame 50, which may take any suitable form. The cable 41 has a distal end attached to a handle 410. In use, the user can grasp the handle 410 to perform an exercise. The cable 41 extends from the distal end to pass in-between the first and second pulleys 58, 59, which are attached to a bogey 56. The first and second pulleys 58, 59 are vertically orientated, with the second pulley 59 being generally directly above the first pulley 58, and are independently rotatable about respective first and second axes. The bogey 56 is attached to the frame 50 and may move vertically along a range of motion, preferably from a height corresponding to a user's ankles to about the user's head height and the bogey 56 may be temporarily fixed at an attachment point (or any of a series of spaced-apart attachment points) so that a user may use the handle 410 at a preferred height. The cable 41 extends upwards from the bogey 56, to pass over a third pulley 42, which is preferably arranged at about head height. The third pulley 42 is vertically orientated and is rotatable about a third axis.

The cable 41 may have a rubber ball or a similar stop element (not shown) attached close to the distal end of the cable 41. The rubber ball may be located in-between the handle 410 and the bogey 56, such that if the handle 410 is removed from the distal end of the cable 41, the distal end of the cable 41 cannot pass through the first and second pulleys 58, 59.

The cable 41 extends downwards from the third pulley 42, to pass under the fourth pulley 43, which is preferably arranged at about waist height. The fourth pulley 43 is vertically orientated, is rotatable about a fourth axis and can move in both directions along a first, generally vertical linear axis. The fourth pulley 43 may be arranged to move along a vertical track (not shown), for example, to allow this motion to take place.

The cable 41 extends upwards from the fourth pulley 43 to pass over the fifth pulley 45, which is preferably arranged at a similar height to the third pulley 42. The fifth pulley 45 is vertically orientated and is rotatable around a fifth axis. The cable 41 extends away from the fifth pulley 45, in a generally horizontal direction that is away from the third pulley 42 and the fourth pulley 43, such that about a quarter of the surface of the fifth pulley 45 is in contact with the cable 41, to pass over the sixth pulley 46, which is preferably arranged at a similar height to the third pulley 42 and the fifth pulley 45. The sixth pulley 46 is vertically orientated and is rotatable around a sixth axis. The cable 41 extends downwards from the sixth pulley 46, to pass under the seventh pulley 47, which is preferably arranged at about waist height. The seventh pulley 47 is vertically orientated, is rotatable around a seventh axis and can move in both directions along a second linear axis. Once again, the seventh pulley 47 may slide along a vertical track during this motion.

The cable 41 extends upwards from the seventh pulley 47, to pass over the eighth pulley 53, which again is preferably arranged at about waist height. The eighth pulley 53 is vertically orientated and is rotatable around an eighth axis. The cable extends downwards from the eighth pulley 53 to pass under the ninth pulley 54, which is preferably arranged at or around about foot height. The ninth pulley 54 is vertically orientated and is rotatable around a ninth axis. The cable 41 extends away from the ninth pulley 54 in a generally horizontal direction that is towards the third pulley 42 and the first pulley 58, such that about a quarter of the surface of the ninth pulley 54 is in contact with the cable 41, to pass under the tenth pulley 55, which is preferably arranged at a similar height to the ninth pulley 54. The tenth pulley 55 is vertically orientated and is rotatable around a tenth axis. The cable 41 extends upwards from the tenth pulley 55 to meet the bogey 56 at an attachment point 57; the proximal end of the cable 41 is attached to the attachment point 57. In another embodiment of the present invention, the attachment point 57 may not be present and the end of the cable 41 is welded directly to the bogey 56 of the exercise machine.

The cable 41 is continuously threaded through the channel created by the first pulley 58 and the second pulley 59, and is continuously threaded around the third pulley 42, the fourth pulley 43, the fifth pulley 45, the sixth pulley 46, the seventh pulley 47, the eighth pulley 53, the ninth pulley 54 and the tenth pulley 55. A weight stack 44 is attached to the fourth pulley 43 and applies an internal force, in a first (i.e. downward) direction due to gravity, to the fourth pulley 43. The weight stack 44 may be arranged to move along a vertical track (not shown), for example, to allow the weight stack to move in both directions along a first, generally vertical linear axis.

A user force is applied by a user through the handle 410. In practice, a user pulls the handle 410 to lift the weight stack 44. The user exerts a force on the handle 410 in order to lift the weight stack 44 and in doing so, the handle 410 exerts an equal and opposite force on the user. In practice, the user will pull the handle 410 away from the bogey 56 to raise the weight stack 44 against gravity, and will then move the handle 410 towards the bogey 56 to lower the weight stack 44 again to complete one repetition of an exercise.

The exercise machine 40 further includes a second cable 52, which (in this example) is entirely separate from the cable 41 discussed above. The second cable 52 is attached at a distal end to a winch 48 and is attached at a proximal end to the seventh pulley 47. The winch 48 may be operated to rotate a drum (not shown) around which the second cable 52 is wound. The winch 48 may therefore increase or decrease the length of the second cable 52 that extends from the winch 48. The winch 48 is placed generally below the seventh pulley 47. The seventh pulley 47 has a sprung mechanism (not shown), which biases the seventh pulley 47 upwards and provides tension in the cable between the winch 48 and the seventh pulley 47. When the amount of cable between the winch 48 and the seventh pulley 47 is increased, the seventh pulley 47 moves in an upwards direction, away from the winch 48. When the amount of cable between the winch 48 and the seventh pulley 47 is decreased, the seventh pulley 47 moves in a downwards direction towards the winch 48.

The fifth pulley 45 may comprise an entry point. There is an initial length of cable 41 between the entry point and the handle 410. By reducing the amount of cable between the winch 48 and the seventh pulley 47, the seventh pulley 47 moves in a downwards direction which (in the absence of any other motion) decreases the amount of cable 41 between the entry point and the handle 410. By increasing the amount of cable between the winch 48 and the seventh pulley 47, the seventh pulley 47 moves in the upwards direction, which increases the amount of cable 41 between the entry point and the handle 410. The fourth pulley 43 may (if the handle 410 is held still) be moved along the first linear axis in both directions by changing the amount of cable between the entry point and the handle 410. Assuming that the handle 410 is kept at a constant position, when the amount of cable between the entry point and the handle 410 is decreased, the fourth pulley 43 will move in the upwards direction and when the amount of cable between the entry point and the handle 410 is increased, the fourth pulley 43 will move in a downwards direction.

In use, the user interacts with the handle 410 and performs a first motion when the handle 410 is moved in a first direction and a second motion when the handle 410 is moved in a second direction, which will usually be generally opposite to the first direction. These movements may comprise a concentric user movement and an eccentric user movement. As discussed above, a concentric user movement is a movement where the user's muscle is contracting and an eccentric user movement is where the user's muscle is extending.

A difference between the embodiments shown in FIGS. 1 and 2 and the embodiment depicted in FIG. 3 is the addition of a bogey 56. The bogey 56 allows a user to adjust the height of the handle 410. An advantage of the arrangement shown in FIG. 3 is that the user can adjust the height of the handle 410 in order to perform different exercises.

The embodiment shown in FIG. 4 comprises a fourth exercise machine 60 (only part of which is shown). The exercise machine 60 comprises a first cable 61, and first to eleventh pulleys 68, 69, 62, 63, 64, 65, 66, 73, 74, 77, 78. These components are held in place by a frame 81, which may take any suitable form. The first cable 61 has a distal end attached to a handle 610. In use, the user can grasp the handle 610 to perform an exercise. The first cable 61 extends from the distal end to pass in-between the first and second pulleys 68, 69, which are attached to a bogey 70. The first and second pulleys 68, 69 are vertically orientated, with the second pulley 69 being generally directly above the first pulley 68, and are independently rotatable about respective first and second axes. The bogey 70 is attached to the frame 81 and may move vertically along a range of motion, preferably from a height corresponding to a user's ankles to about the user's head height and the bogey 70 may be temporarily fixed at an attachment point (or any of a series of spaced-apart attachment points) so that a user may use the handle 610 at a preferred height. The first cable 61 extends upwards from the bogey 70, to pass over a third pulley 62, which is preferably arranged at about head height. The third pulley 62 is vertically orientated and is rotatable about a third axis.

The first cable 61 may have a rubber ball or a similar stop element (not shown) attached close to the distal end of the first cable 61. The rubber ball may be located in-between the handle 610 and the bogey 70, such that if the handle 610 is removed from the distal end of the first cable 61, the distal end of the first cable 61 cannot pass through the first and second pulleys 68, 69.

The first cable 61 extends downwards from the third pulley 62, to pass over a fourth pulley 63, which is preferably arranged at about chest height. The fourth pulley 63 is vertically orientated and is rotatable about a fourth axis.

The first cable 61 extends downwards from the fourth pulley 63, such that about a quarter of the surface of the fourth pulley 63 is in contact with the cable, to pass under the fifth pulley 64, which is preferably arranged vertically below the fourth pulley 63. The fifth pulley 64 is vertically orientated and is rotatable about a fifth axis and can move in both directions along a first, generally vertical linear axis.

The first cable 61 extends upwards from the fifth pulley 64, to pass over a sixth pulley 65, which is preferably arranged in a position that is in-between the bogey 70, the fourth pulley 63 and the fifth pulley 64. The sixth pulley 65 is vertically orientated and is rotatable about a sixth axis.

The first cable 61 extends downwards from the sixth pulley 65, to pass under a seventh pulley 66, which is preferably arranged at about foot height and vertically below the third pulley 62. The seventh pulley 66 is vertically orientated and is rotatable about a seventh axis. The first cable 61 extends upwards from the seventh pulley 66 to meet the bogey 70 at a first attachment point 67. In another embodiment of the present invention, the first attachment point 67 may not be present and the end of the first cable 61 is welded directly to the bogey 70 of the exercise machine.

At a first end, a member 71 is attached to the fifth pulley 64. The member 71 extends vertically downwards from the fifth pulley 64. At a second end, the member 71 is attached to an eighth pulley 74, which is preferably arranged in the same vertical plane as the fourth 63 and fifth 64 pulleys. The eighth pulley 74 is vertically orientated and is rotatable about an eighth axis and can move in both directions along a first, generally vertical linear axis. At the distal end of the member 71 to which the eighth pulley 74 is attached, is a second attachment point 72.

A second cable 79 extends downwards from the second attachment point 72, to pass under a ninth pulley 73, which is preferably arranged in the same vertical plane as the fourth 63, fifth 64 and eighth 74 pulleys. In another embodiment of the present invention, the second attachment point 72 may not be present and the end of the second 79 cable 61 is welded directly to the bogey 70 of the exercise machine. The ninth pulley 73 is vertically orientated and is rotatable about a ninth axis and can move in both directions along a first, generally vertical linear axis.

The second cable 79 extends upwards from the ninth pulley 73, passes over the eighth pulley 74 and extends downwards towards a tenth pulley 77, which is preferably arranged at about foot level. The tenth pulley 77 is vertically orientated and is rotatable about a tenth axis.

The second cable 79 extends upwards from the tenth pulley 77 to pass over an eleventh pulley 78, which is preferably arranged at head height. The eleventh pulley 78 is vertically orientated and is rotatable about an eleventh axis. The cable extends in a downwards direction from the eleventh pulley 78 and is attached at a distal end to a winch 80. The winch 80 may be operated to rotate a drum (not shown) around which the second cable 79 is wound. Preferably, the winch 80 is generally below the eleventh pulley 78 and at foot level.

A weight stack 76 is attached to the ninth pulley 73 and applies an internal force, in a first (i.e. downward) direction due to gravity, to the moveable ninth pulley 73. The weight stack 76 may be arranged to move along a vertical track (not shown), for example, to allow the weight stack to move in both directions along a first, generally vertical linear axis. A user force is applied by a user through the handle 610. A user pulls a handle 610 to lift the weight stack 76. The user exerts a force on the handle 610 in order to lift the weight stack 76 and in doing so, the handle 610 exerts and equal and opposite force on the user. In practice, the user will pull the handle 610 away from the bogey 70 to raise the weight stack 76 against gravity, and will then move the handle 610 towards the bogey 70 to lower the weight stack 76 again to complete one repetition of an exercise.

The sixth pulley 65 may comprise an entry point. There is an initial length of first cable 61 between the entry point and the handle 610. By moving the handle 610 away from the bogey 70, the amount of first cable 61 between the entry point and the handle 610 is increased. By moving the handle 610 towards the bogey 70, the amount of first cable 61 between the entry point and the handle 610 is decreased. By increasing the amount of cable between the entry point and the handle 610, the fifth pulley 64 moves in the upwards direction which moves the member 71 and the eighth pulley 74 in the upwards direction also. This upwards movement of the eighth pulley 74 decreases the amount of cable between the eighth pulley 74 and the second attachment point 72. The ninth pulley 73 may (if the winch 80 is locked) be moved along the first linear axis in both directions by changing the amount of cable between the entry point and the handle 610. Assuming that the winch 80 is locked, when the amount of first cable 61 between the entry point and the handle 610 is increased, the ninth pulley 73 will move in the upwards direction and when the amount of first cable 61 between the entry point and the handle 610 is decreased, the ninth pulley 73 will move in the downwards direction.

As the ninth pulley 73 is attached to the weight stack 76, the weight stack 76 will move up and down as the ninth pulley 73 moves.

As described below, the amount of work done by the user when moving the handle 610 may be varied by adjusting how much of the second cable 79 the winch 80 pays out when the user is performing a user action.

In use, the user interacts with the handle 610 and performs a first motion when the handle 610 is moved in a first direction and a second motion when the handle 610 is moved in a second direction, which will usually be generally opposite to the first direction. These movements may comprise a concentric user movement and an eccentric user movement. A concentric user movement is a movement where the user's muscle is contracting and the eccentric user movement is where the user's muscle is extending.

A difference between the embodiments shown in FIGS. 1-3 and the embodiment shown in FIG. 4 is that there is a first cable 61 and a second cable 79, the two cable arrangements being connected by the member 71. An advantage of such an arrangement is that the first cable 61 is threaded through fewer pulleys than the cable 11, 21, 41 attached to the handle 110, 210, 410 of the previous embodiments. As the first cable 61 is threaded through fewer pulleys, the pulleys impart a lower resistance when compared to the number pulleys through which the cable 11, 21, 41 of the embodiments shown in FIGS. 1-3 is threaded and hence the exercise machine 60 feels more responsive than the exercise machines 10, 20, 40 shown in FIGS. 1-3. Furthermore, by isolating the winch 80 from the first cable 61, the user is less able to perceive the operation of the winch 80 when compared to the embodiments of the present invention shown in FIGS. 1-3. If the winch 80 of the present embodiment employs a stepper motor, the advantage of isolating the winch from the user would be more pronounced.

The embodiment shown in FIG. 5 comprises a fifth exercise machine 90 (only part of which is shown). The exercise machine 90 comprises a cable 91, and first to eighth pulleys 101, 102, 92, 93, 95, 96, 97, 98. These components are held in place by a frame 103, which may take any suitable form. The cable 91 has a distal end attached to a handle 910. In use, the user can grasp the handle 910 to perform an exercise. The cable 91 extends from the distal end to pass in between the first and second pulleys 101, 102, which are attached to a bogey 100. The first and second pulleys 101, 102 are vertically orientated, with the second pulley 102 being generally directly above the first pulley 101, and independently rotatable around respective first and second axes. The bogey 100 is attached to the frame 103 and may move vertically along a range of motion, preferably from a height corresponding to a user's ankles to about the user's head height, the bogey 100 may be temporarily fixed at an attachment point (or any other series at spaced-apart attachment points) so that a user may use the handle 910 at a preferred height. The cable 91 extends upwards from the bogey 100, to pass over the third pulley 92, which is preferably arranged at about head height. The third pulley 92 is vertically orientated and is rotatable around a third axis.

The cable 91 may have a rubber ball or a similar stop element (not shown) attached close to the distal end of the cable 91. The rubber ball may be located in between the handle 910 and the bogey 100 such that if the handle 910 is removed from a distal end of the cable 91, the distal end of the cable 91 cannot pass through the first and second pulleys 101, 102.

The cable 91 extends downwards from the third pulley 92, to pass under the fourth pulley 93, which is preferably arranged at about waist height. The fourth pulley 93 is vertically orientated, is rotatable about a fourth axis and can move in both directions along a first, generally vertical linear axis. The fourth pulley 93 may be arranged to move along a vertical track (not shown), for example, to allow this motion to take place.

The cable 91 extends upwards from the fourth pulley 93 to pass over the fifth pulley 95, which is preferably arranged at a similar height to the third pulley 92. The fifth pulley 95 is vertically orientated and is rotatable around a fifth axis. The cable 91 extends away from the fifth pulley 95, in a generally horizontal direction that is away from the third pulley 92 and the fourth pulley 93, such that about a quarter of the surface of the fifth pulley 95 is in contact with the cable 91, to pass over the sixth pulley 96, which is preferably arranged at a similar height to the third pulley 92 and the fifth pulley 95. The sixth pulley 96 is vertically orientated and is rotatable around a sixth axis. The cable 91 extends downwards from the sixth pulley 96, to pass under the seventh pulley 97, which is preferably arranged at about foot height. The seventh pulley is vertically orientated and is rotatable around a seventh axis.

The cable 91 extends away from the seventh pulley in a generally horizontal direction that is away from the seventh pulley 97 and towards the third pulley 92. The cable 91 passes under the eighth pulley 98 which again is preferably arranged at about foot height. The eighth pulley 98 is vertically orientated and is rotatable around an eighth axis. The cable extends upwards from the eighth pulley 98 and the proximal end is attached to a winch 99. The winch 99 is attached to the bogey 100.

The cable 91 is continuously threaded through the channel created by the first pulley 101 and the second pulley 102, and is continuously threaded around the third pulley 92, the fourth pulley 93, the fifth pulley 95, the sixth pulley 96, the seventh pulley 97 and the eighth pulley 98. A weight stack 94 is attached to the fourth pulley 93 and applies an internal force, in a first (i.e. downward) direction due to gravity, to the fourth pulley 93. The weight stack 94 may be arranged to move along a vertical track (not shown), for example, to allow the weight stack to move in both directions along a first, generally vertical linear axis.

A user force is applied by a user through the handle 910. A user pulls the handle 910 to lift the weight stack 94. A user exerts a force on the handle 910 in order to lift the weight stack 94 and in doing so, the handle 910 exerts an equal and opposite force on the user. In practice, the user will pull the handle 910 away from the bogey 100 to raise the weight stack 94 against gravity, and will then move the handle 910 towards the bogey 100 to lower the weight stack 94 again to complete one repetition of an exercise.

The fifth pulley 95 may comprise an entry point. There is an initial length of cable 91 between the entry point and the handle 910. The length of the cable 91 between the entry point and the handle 910 may be changed by operation of the winch 99. By reducing the amount of cable between the winch 99 and the entry point, the amount of cable between the entry point and the handle 910 is also reduced. By increasing the amount of cable between the winch 99 and the entry point, the amount of cable between the entry point and the handle 910 is also increased. The fourth pulley 93 may (if the handle 910 is held still) be moved along the first linear axis in both directions by changing the length of the cable 91 between the entry point and the handle 910. Assuming that the handle 910 is kept at a constant position, when the length of the cable 91 between the entry point and the handle 910 is decreased, the fourth pulley 93 will move in an upwards direction and when the length of the cable 91 between the entry point and the handle 910 is increased, the fourth pulley 93 will move in a downwards direction. The movement of the fourth pulley 93 will rise and lower the weight stack 94 accordingly.

As described below, the amount of work done by the user when moving the handle 910 may be varied by adjusting the length of the cable 91 that the winch 99 pays out when the user is performing a user action.

In use, the user interacts with the handle 910 and performs a first motion when the handle 910 is moved in a first direction and a second motion when the handle 910 is moved in a second direction, which will usually be generally opposite to the first direction. These movements may comprise a concentric user movement and an eccentric user movement. A concentric user movement is a movement where the user's muscle is contracting and an eccentric user movement is where the user's muscle is extending.

A difference between the embodiment shown in FIG. 3 and the embodiment depicted in FIG. 5 is the arrangement of the winch 99. The winch 99 is connected directly to the bogey 100. An advantage of attaching the winch 99 directly to the bogey 100 is that the exercise machine has two fewer pulleys and as a result is simpler and more cost efficient.

The embodiment shown in FIG. 6 comprises a sixth exercise machine 120 (only part of which is shown). The exercise machine 120 comprises a first cable 121, a second cable 127, a third cable 131, first to third reels 123, 124, 125, a guide wheel 126 and first to fifth pulleys 135, 136, 122, 129, 130. These components are held in place by a frame 133, which may take any suitable form. The first cable 121 has a distal end attached to a handle 1010. In use, the user can grasp a handle 1010 to perform an exercise. The first cable 121 extends from the distal end to pass in between the first and second pulleys 135, 136, which are attached to a bogey 134. The first and second pulleys 135, 136 are vertically orientated, with the second pulley 136 being generally directly above the first pulley 135, and independently rotatable around respective first and second axes. The bogey 134 is attached to the frame 133 and may move vertically along a range of motion, preferably from a height corresponding to a user's ankles to about the user's head height and the bogey 134 may be temporarily fixed at an attachment point (or any other series of spaced-apart attachment points) so that a user may use the handle 1010 at a preferred height. The first cable 121 extends upwards from the bogey 134, to pass over a third pulley 122, which is preferably arranged at about head height. The third pulley 122 is vertically orientated and is rotatable around a third axis.

The first cable 121 may have a rubber ball or a similar stop element (not shown) attached close to the distal end of the first cable 121. The rubber ball may be located in between the handle 1010 and the bogey 134, such that if the handle 1010 is removed from the distal end of the first cable 121, the distal end of the first cable 121 cannot pass through the first and second pulleys 135, 136.

The first cable 121 extends downwards from the third pulley 122, to pass under the first reel 123, which is preferably arranged at about chest height. The proximal end of the first cable 121 is attached to the first reel 123, an extended length of cable is wrapped around the first reel such that multiple rotations (for example one, two, three, four or five rotations) may take place. The first reel 123 is vertically orientated, is rotatable around a fourth axis and is attached to a first end of a continuously variable transmission (not shown). Attached to the second end of the variable transmission, is a third reel 125.

The third reel 125 is vertically orientated and is rotatable around the fourth axis. In between the first reel 123 and the third reel 125 is a second reel 124. The second reel 124 is vertically orientated and is rotatable around the fourth axis. The second reel 124 is attached to the third reel 125 by a locking/free-wheeling mechanism (not shown).

The second cable 127 is attached at a proximal end to the third reel 125 and is wrapped around the third reel 125 a number of times (for example one, two, three, four or five times). and extends in a generally downwards direction passing by a guide wheel 126 attached at a distal end to a weight stack 128.

A third cable 131 is attached to the second reel 124 at a proximal end and is wrapped around the second reel 124, for example two, three, four times etc. The third cable 131 extends in a generally downward direction towards a fourth pulley 129. The fourth pulley 129 is preferably arranged at about foot height. The fourth pulley is vertically orientated and is rotatable around a fifth axis. The third cable 131 passes around the fourth pulley 129 and extends in a generally upwards direction towards a fifth pulley 130. The fifth pulley 130 is preferably arranged at a similar height to the third pulley 122. The fifth pulley 130 is vertically orientated and is rotatable around a seventh axis. The third cable 131 passes over a fifth pulley 130 and extends in a generally downwards direction towards a winch 132. The third cable 131 is attached to a proximal end to a winch 132. The winch 132 may be operated to rotate a drum (not shown) around which the third cable 131 is wound. The winch 132 may therefore increase or decrease the length of the third cable 131 that extends from the winch 132. The winch 132 is placed generally below the fifth pulley 130.

A user force is applied by a user through the handle 1010. A user pulls the handle 1010 to lift the weight stack 128 and in doing so, the handle 1010 exerts an equal and opposite force on the user. In practice, the user will pull the handle 1010 away from the bogey 134 to raise the weight stack 128 against gravity, and will then move the handle 1010 towards the bogey 134 to lower the weight stack 128 again to complete one repetition of an exercise.

In use, the user interacts with the handle 1010 and performs a first motion when the handle 1010 is moved in a first direction and a second motion when the handle 910 is moved in a second direction, which will usually be generally opposite to the first direction. These movements may comprise a concentric user movement and an eccentric user movement.

In this embodiment, when the user performs a concentric user movement, the locking/free-wheeling mechanism is set to free-wheeling mode (either manually by the user, or through the processor detecting the movement and switching automatically to this mode). The concentric user movement will cause the first reel 123 to rotate in a first direction, which in FIG. 6 corresponds to a clockwise motion. The clockwise motion of the first reel 123 is passed through the continuously variable transmission and effects a movement in the same first direction in the third reel 125. The rotation of the third reel 125 will cause the weight stack 128 to rise.

In this embodiment, when the user has finished the concentric user movement, the continuously variable transmission is now set to free-wheeling mode and the locking/free-wheeling mechanism is set to locked mode. If the winch 132 is required to alter the position of the weight stack 128, the amount of third cable 131 is reduced or increased, which will cause the second reel 124 to rotate, the third reel 125 also will rotate and hence the weight stack 128 will move, without altering the length of first cable 121.

In this embodiment, when the user performs an eccentric user movement, the continuously variable transmission is set to locked mode and the locking/free-wheeling mechanism is set to free-wheeling mode and hence the weight stack 132 may be lowered.

The fourth axis may comprise an entry point. There is an initial length of first cable 121 between the entry point and the handle 1010. By moving the handle 1010 away from the bogey 134, the amount of first cable 121 between the entry point and the handle 1010 is increased. By moving the handle 1010 towards the bogey 134, the amount of first cable 121 between the entry point and the handle 1010 is decreased. By increasing the amount of first cable 121 between the entry point and the handle 1010, the first reel 123 rotates in a first direction and hence the third reel 125 also rotates in the first direction. The rotation of the third reel 125 in the first direction decreases the amount of second cable 127 between the weight stack 128 and the third reel 125. The weight stack 128 may (if the winch 132 is locked) be moved along a first linear axis in both directions by changing the amount of cable between the entry point and the handle 1010. Assuming that the winch 132 is locked, when the amount of first cable 121 between the entry point and the handle 1010 is increased, the weight stack 128 will move in the upwards direction and when the amount of first cable 121 between the entry point and the handle 1010 is decreased, the weight stack 128 will move in the downwards direction.

A difference between the embodiments shown in FIGS. 1-5 and the embodiment depicted in FIG. 6 is the addition of first to third reels 123, 124, 125, the continuously variable transmission and the arrangement of the first to third cables 121, 127, 131. An advantage of such an arrangement is that the first cable 121 is threaded through fewer pulleys than the cable 11, 21, 41, 61, attached to the handle 110, 210, 410, 610, 910 of the previous embodiments. As the first cable 121 is threaded through fewer pulleys, the pulleys impart a lower resistance when compared to the number pulleys through which the cable 11, 21, 41, 61, 91 of the embodiments shown in FIGS. 1-5 is threaded and hence the exercise machine 120 feels more responsive than the exercise machines 10, 20, 40, 60, 90 shown in FIGS. 1-5. Furthermore, by isolating the winch 132 from the first cable 121, the user is less able to perceive the operation of the winch 132 when compared to the embodiments of the present invention shown in FIGS. 1-5. If the winch 132 of the present embodiment employs a stepper motor, the advantage of isolating the winch 132 from the user would be more pronounced.

Other embodiments of the present invention may replace the handle 110, 210, 410, 610, 910, 1010 (and bogey 56, 70, 100, 134 where appropriate) with any other member, such that the embodiments can be used to perform a wide variety of exercises. An example of a different member is a lever to allow the user to perform leg extensions.

An example of use of the exercise machines 10, 20, 40, 60, 90, 120 will now be described.

The user is likely to perform the concentric movement first, which, in the embodiments of FIGS. 1 and 2 is pulling the handle 110, 210 downwards and in the embodiments of FIGS. 3-6, is moving the handle 410, 610, 910, 1010 away from the bogey 56, 70, 100, 134. The exercise machine 10, 20, 40, 60, 90, 120 has means for monitoring the first motion and during the first motion, the exercise machine 10, 20, 40, 60, 90, 120 applies a first mode of operation.

As the user performs the first motion, the winch 18, 28, 48, 80, 99, 132 may increase the amount of cable in the system, as part of the first mode of operation. If the user moves the handle 110, 210, 410, 610, 910, 1010 through one unit of distance, the winch 18, 28, 48, 80, 99, 132 may increase the amount of cable in the system at a rate that is proportional to or commensurate with the rate at which the user moves the handle 110, 210, 410, 610, 910, 1010. In one example, the winch 18, 28, 48, 80, 99, 132 may introduce 0.5 units of cable 21, 32, 52, 79 (or in in the embodiment known from FIG. 4, second cable 91, or in the embodiment known from FIG. 6, third cable, 131) into the system. This means that for every unit of increase in distance between the handle 110, 210, 410, 610, 910, 1010 and the first pulley 12, 22, 42, 62, 92, 122, the user will raise the weight by only 0.25 units (or in the embodiment known from FIG. 6, the distance that the user will raise the weight may be different, depending on the setting of the continuously variable transmission).

In this example, as the user performs the first motion, the weight lifted by the user appears to be less than if the first mode of operation was not applied. More particularly, the effective weight experienced by the user is half of the weight that would be experienced without the operation of the winch 18, 28, 48, 80, 99, 132 (or in the embodiment known from FIG. 6, the effective weight that the user will experience may be different, depending on the setting of the continuously variable transmission).

Ideally, the winch 18, 28, 48, 80, 99, 132 tracks the user's movement quickly and in real time, to give an effective weight that is experienced by the user that is half of the real weight, regardless of how quickly the user moves the handle 110, 210, 410, 610, 910, 1010. The user's movement may be monitored in any suitable way, and some examples are given below. A sensor may be attached to the first pulley 12, 22 (or in the case of the embodiments known from FIGS. 3, 4, 5, 6, the third pulley 42, 62, 92, 122) and the sensor may be a rotational encoder. The sensor may detect the rate of rotation of the pulley 12, 22 (or in the case of the embodiments known from FIGS. 3, 4, 5, 6 the third pulley 42, 62, 92, 122) and communicate this information to the winch in real-time. The pulley 12, 22 (or in the case of the embodiment known from FIGS. 3, 4, 5, 6 the third pulley 42, 62, 92, 122) may, for example, have a marking or series of markings on it, which the sensor detects when the/each marking passes the sensor. The winch may take this information and apply a scaling factor in order to introduce cable into the system at a rate which is, at any moment, maintained in a predetermined proportion to the rate at which the user is adding it to the system.

In this embodiment of the present invention, the exercise machine 10, 20, 40, 60, 90, 120 has a distance ratio of 2 (or in the embodiment known from FIG. 6, the ratio may be different, depending on the setting of the continuously variable transmission). The distance ratio is the ratio between how far the user is required to move the handle 110, 210, 410, 610, 910, 1010 to move the weight stack 14, 24, 44, 76, 94, 128 through a set unit of distance, compared to the distance through which the handle 110, 210, 410, 610, 910, 1010 must be moved to move the weight stack 14, 24, 44, 76, 94, 128 through the same set distance if the winch 18, 28, 48, 80, 99, 132 is locked and performs no activity (and in the embodiment known from FIG. 6, the setting of the continuously variable transmission is locked). A distance ratio of two means that the user will have to move the handle 110, 210, 410, 610, 910, 1010 through a distance that is twice the distance that the user would have to move the handle 110, 210, 410, 610, 910, 1010 if the winch 18, 28, 48, 80, 99, 132 was locked in order to move the weight stack 14, 24, 44, 76, 94, 132 through a set unit of distance.

The exercise machine 10, 20, 40, 60, 90, 120 has means for detecting when the first motion has been completed. There are many ways to detect when the first motion has been completed and embodiments of the present invention are not limited to a specific means of detection.

Some embodiments of the present invention may comprise a sensor for detecting distance by which the handle 110, 210, 410, 610, 910, 1010 has been moved by the user. The sensor may (as discussed above) be a rotational encoder and measure the rotational rate of the first pulley 12, 22 (or in the case of the embodiments known from FIGS. 3, 4, 5, 6 the third pulley 42, 62, 92, 122) or one or more other pulleys. The sensor may alternatively monitor the length of cable that has passed the third pulley 15, 25 (or in the case of the embodiment known from FIGS. 3, 5, 6 the fifth pulley 45, 95, 130, or in the case of the embodiment known from FIG. 4 the seventh pulley 78). This sensor may further comprise a memory and a processor. The sensor may have a value stored in the memory that represents a distance by which the handle 110, 210, 410, 610, 910, 1010 has moved for the user to have finished the first motion. The sensor may retrieve the value from the memory and compare the value to the sensed distance. If the sensed distance is equal to or greater than the value stored in the memory, this indicates that the user has completed the first motion. In this embodiment, no other sensing means may be required.

Other embodiments of the present invention may comprise a sensor for monitoring the force that the user is applying to the handle 110, 210, 410, 610, 910, 1010. The sensor may comprise a strain gauge attached to the second pulley 13, 23 (or in the case of the embodiments known from FIGS. 3, 5 the fourth pulley 43, 93 or in the case of the embodiment known from FIG. 4, the eighth pulley 73, or in the case of the embodiment known from FIG. 6, the third reel 125) (or another part of the system), such that the strain gauge monitors the force applied to the weight stack 14, 24, 44, 76, 94, 128. The sensor may further comprise a memory and a processor. The sensor may store a value in the memory, which represents the force applied to the weight stack 14, 24, 44, 76, 94, 128. Taking information from other sensors in order to calculate the distance through which the weight stack has been moved, the exercise machine 10, 20, 40, 60, 90, 120 may calculate the work done by the user during a repetition.

When the rate of change of force with respect to time is equal to zero (or is below a threshold value), the sensor may indicate that the user movement has stopped. However, this could merely indicate that the user has paused during a user motion, rather than that the user has finished a user motion.

In other embodiments of the present invention, in order to determine whether the user has completed the first motion, a number of sensors may be used in combination.

Taking the embodiment known from FIG. 1 as an example, as the user performs the first motion, the winch 18 is locked and does not adjust the length of cable 11 in system. If the winch is locked, once the user has completed the first motion, the user will (in the embodiment shown in FIG. 1) have lifted a weight through a distance that is half that of the increase in the distance between the handle 110 and the first pulley 12.

A control unit detects when the user has completed the first motion. This may be detected (as described above) through a sensor attached to the first pulley 12, 22 (or in the case of the embodiments known from FIGS. 3, 4, 5, 6 the third pulley 42, 62, 92, 122), any other pulley, the handle 110, 210, 410, 610, 910, 1010 or any other positions where movement of the cable may be detected. A first sensor may monitor whether a pulley has stopped moving. A second sensor may monitor the amount of cable 11, 21, 41, 91 (or in the embodiments known from FIGS. 4 and 6, the first cable 61, 121) that has passed over a pulley. The control unit may take inputs from these sensors and calculate once the user has finished the first motion.

In some embodiments, once the user has stopped moving, the user indicates that they have finished the first motion through the use of a switch on the handle 110, 210, 410, 610, 910, 1010. Alternatively, in other embodiments of the present invention, the user may use voice recognition, eye movement sensors instead of a switch, or the control unit may compare the amount of cable between the entry point and the handle 110, 210, 410, 610, 910, 1010 to a standard distance and calculate the probability that the user has finished the first motion.

In this embodiment, there is a third mode of operation after the first. Once the user has performed the first motion, the control unit may send instructions to an indicator to display an indication to the user not to start the second motion, which may be an eccentric movement. Once the user has completed the first motion, the control unit may start the third mode of operation and instruct the winch 18, 28, 48, 80, 99, 132 to reduce the amount of cable 11, 21, 41, 91, (or in the embodiment known from FIG. 4, second cable 79 or in the embodiment known from FIG. 6, third cable 131) in the system, thereby increasing the height of the weight stack 14, 24, 44, 76, 94, 128. The exercise machine 10, 20, 40, 60, 90, 120 may calculate the increase in the height of the weight stack 14, 24, 44, 76, 94, 128 based on the distance ratio and instruct the winch 18, 28, 48, 80, 99, 132 to raise the weight stack 14, 24, 44, 76, 94, 128 to a height that the user would have lifted it to in the first motion if there had been no compensatory action provided by the winch 18, 28, 48, 80, 99, 132.

In other embodiments of the present invention, the winch may raise the weight stack 14, 24, 44, 76, 94, 128 to a height that is different from the position that the user would have lifted it to in the first motion if there had been no compensatory action provided by the winch 18, 28, 48, 80, 99, 132. The winch 18, 28, 48, 80, 99, 132 may raise the weigh stack 14, 24, 44, 76, 94, 128, to a height that is lower or higher than the user would have lifted it to in the first motion. An advantage of the winch 18, 28, 48, 80, 99, 132 moving the weight stack 14, 24, 44, 76, 94, 128 is that different distance ratios for the first and second motions may be achieved, including ratios that change as the user performs a number of repetitions. For example, the user may perform a set that comprises ten repetitions. Of the set comprising ten repetitions, the distance ratio may be a ratio of 2 for the first motion of the first five repetitions and the distance ratio may be a ratio of 4 for the first motion of the second five repetitions.

Once the winch 18, 28, 48, 80, 99, 132 has increased the height of the weight stack 14, 24, 44, 76, 94, 128 in the third mode of operation, an indication may be displayed to the user, indicating that the user may perform the second motion. In this example, the winch 18, 28, 48, 80, 99, 132 provides no compensatory motion and is simply "locked". In the second mode of operation. The user lowers the weight through a longer distance, for each unit of distance moved by the handle 110, 210, 410, 610, 910, 1010 whilst performing the second motion than is the case whilst performing the first motion, so that the user effectively experiences a greater weight whilst performing the second motion. During the second motion, in this embodiment, there is a distance ratio of 1 (or in the embodiment known from FIG. 6, the user may use the continuously variable transmission to set a different distance ratio).

In other examples the winch 18, 28, 48, 80, 99, 132 performs a compensatory motion during the second phase, or indeed a motion that increases the effective weight experienced.

The control unit calculates once the user has finished the second motion. This may again be based on a sensor which detects once a pulley has stopped moving. In some embodiments, the control unit may receive an input from a sensor that measures how much cable has passed a pulley.

Once the second motion has finished, the exercise machine 10, 20, 40, 60, 90, 120 is ready for the start of the first motion again for a new repetition.

After the second motion and before a further first motion, there may be a fourth mode of operation. Once the user has completed the second motion, the control unit may start the fourth mode of operation and instruct the winch 18, 28, 48, 80, 99, 132 to increase the amount of cable 11, 21, 41, 91, (or in the embodiment known from FIG. 4, second cable 79, or in the embodiment known from FIG. 6, third cable 131) in the system, thereby decreasing the height of the weight stack 14, 24, 44, 76, 94, 128. It does not apply to the present example, but in some embodiments of the present invention, the user may finish the second motion and the weight stack 14, 24, 44, 76, 94, 128 may not be at the same position as when the user started the second motion. If this is the case, the exercise machine 10, 20, 40, 60, 90, 120 may calculate the amount of cable 11, 21, 41, 91 (or in the embodiment known from FIG. 4, second cable 79 or in the embodiment known from FIG. 6, third cable 131) that needs to be introduced into the system in order lower the weight stack 14, 24, 44, 76, 94, 128 to ground level.

In some embodiments of the present invention, the user may perform the first motion or the second motion without the exercise machine 10, 20, 40, 60, 90, 120 making any active adjustment to the length of cable in the system.

With reference to FIG. 7, controls can be provided to a user to control the ratio and the workout.

At step 301, the user selects a setting that controls the amount of weight to be lifted. Alternatively, this may be permanently set, or indeed a traditional pin system may be provided to allow the user to select a number of weights in the stack to be lifted. Optionally, the user then selects whether to workout using a constant cam or an asymmetric cam (described in greater detail below) at step 302. At step 303, the user selects the distance ratio for the concentric user movement and (separately) the eccentric user movement. In this embodiment the user selects a ratio of 2 for the concentric user movement and a ratio of 1 for the eccentric user movement.

In this example, in order to provide a good level of monitoring and to increase the accuracy of the monitoring, the exercise machine takes five inputs from a plurality of sensors (there may be more than one sensor per input) and has a separate control unit, communicatively coupled to the plurality of sensors. The control unit takes a number of inputs, the external force applied by the user 304, the tension at the first pulley 305, the tension at the second pulley 306, the tension at the third pulley 307, the displacement of the second pulley 308 and the displacement of the handle 309, that are communicated to the control unit and are stored in a memory of the control unit. The control unit retrieves from the memory a value representing how far the user will move the handle 110, 210, 410, 610, 910, 1010 and then calculates the internal force that will be applied to the user, based on the ratio selected by the user. In other embodiments, the control unit may receive an input representing a unique ID associated with a user and can retrieve from a memory a value representing how far this user typically moves the handle 110, 210, 410, 610, 910, 1010. The control unit sends instructions to the winch 18, 28, 48, 80, 99, 132 based on these calculations.

At step 310, the control unit calculates how much cable 11, 21, 41, 91 (or in the embodiment known from FIG. 4, second cable 79 or in the embodiment known from FIG. 6, third cable 131) the winch 18, 28, 48, 80, 99, 132, will need to remove from the system in order for a distance ratio of 2 to be achieved as the user performs the first mode of operation. The amount of cable to be removed from the system is communicated to the winch 18, 28, 48, 80, 99, 132 and the winch 18, 28, 48, 80, 99, 132 removes the cable from the system as the user performs the first motion.

The user performs the first motion and at step 313 the exercise machine 10, 20, 40, 60, 90, 120 detects once the user has finished the first motion (as discussed above). At step 314, the exercise machine performs the third motion and instructs the winch 18, 28, 48, 80, 99, 132 to reduce the amount of cable 11, 21, 41, 91 (or in the embodiment known from FIG. 4 second cable 79 or in the embodiment known from FIG. 6, third cable 131) in the system, based on the distance ratio, thereby increasing the height of the weight stack 14, 24, 44, 79, 91, 121.

At step 315, the control unit calculates whether to start the second mode of operation and introduce more cable 11, 21, 41, 91 (or in the embodiment known from FIG. 4, second cable 79, or in the embodiment known from FIG. 6, third cable 131) into the system as the user is performing the second motion. This may be based on the distance ratio indicated by the user in step 303.

In other embodiments of the present invention, the user or a third party may indicate to the control unit that they have completed a first or second motion. This may be via a switch on any part of the exercise machine 10, 20, 40, 60, 90, 120, (particularly a switch on the handle, or a foot switch) through voice recognition or by an eye movement sensor. The means of indicating to the control unit that the user has completed a first or second motion may be communicatively connected to the control unit through wired or wireless means. In other embodiments, an accelerometer may be attached to the handle 110, 210, 410, 610, 910, 1010 and the accelerometer may be connected to the control unit by wired or wireless means. The control unit may use the input from the accelerometer in order to calculate when a user has started or finished a user movement.

A user may also perform initial first and second motions with a light weight, such as the lightest weight on the weight stack 14, 24, 44, 76, 94, 128 or, alternatively, an even lighter calibration weight, in order that the control unit can calibrate a range of motion.

Once the user has finished the second motion, the control system then calculates if an adjustment needs to be made to the amount of cable 11, 21, 41, 91 (or in the embodiment known from FIG. 4, second cable 79, or in the embodiment known from FIG. 6, third cable 131) in the system before a further first motion is started, if an adjustment to the amount of cable 11, 21, 41, 91 (or in the embodiment known from FIG. 4, second cable 79, or in the embodiment known from FIG. 6, third cable 131) in the system needs to be made, the control unit will instruct the winch 18, 28, 48, 80, 99, 132 to start a fourth mode of operation. In other embodiments, the control system provides instructions to the winch to adjust the amount of cable 11, 21, 41, 79, 91 (or in the embodiment known from FIG. 4, the second cable 79 or in the embodiment known from FIG. 6, the third cable 131) in the system whilst the user is performing the first motion.

In some embodiments, the control unit continuously monitors the performance of a user and dynamically alters the distance ratio for the first and second motions as the user is exercising. This ratio may be altered when the user is stationary between first and second motions or it may take place whilst the user is performing a first or a second motion. The distance ratio may also change as the user performs repetitions. For example, the distance ratio may require the user to work harder for the first five repetitions and may require the user to work in a relatively easy manner for the second five repetitions. This change in ratio may be programmable or, alternatively, the user may be able to select a change in ratio from a number of pre-set options or simply by outlining a desired ratio curve on a touch screen connected to the control unit. The control unit may also provide instructions to the weight stack 14, 24, 44, 76, 94, 128 or other means of providing the internal force, in order to adjust the internal force as the user is exercising. This adjustment of the internal force may take place when the user is stationary, between first and second motions or it may take place whilst the user is performing a first or a second motion.

Embodiments of the present invention may have an asymmetric cam in place of the first pulley 12, 22 (or in the case of the embodiments known from FIGS. 3, 4, 5, 6 the third pulley 42, 62, 92, 122) or alternatively any other pulley. Other embodiments may present the user with a choice of a constant cam (i.e. a regular pulley) or the asymmetric cam in place of the first pulley 12, 22 (or in the case of the embodiments known from FIGS. 3, 4, 5, 6 the third pulley 42, 62, 92, 122) or alternatively any other pulley. An advantage of using an asymmetric cam as opposed to a constant cam is that the shape of the cam can be tailored to a specific workout and how a user's muscles vary in strength and hence the effective generation of an external force when moving a weight through a repetition.

In some embodiments, the mode of operation may change during a first or second user motion. The advantage of being able to change the mode of operation is that the exercise machine 10, 20, 40, 60, 90, 120 can replicate the action of an asymmetric cam. When performing a repetition with a standard pulley, the resistance provided by the exercise machine to the user's motion will be relatively constant. If an asymmetric cam is used, the resistance will not be constant. For example, if the asymmetric cam has a protrusion, it may take more work to move the cable over the protrusion than it takes to move the cable over a flat part of the cam profile. By changing the mode of operation during the first or second user motion, the exercise machine can remove and introduce cable into the system as the user is performing the repetition, as described above, this will change the effective weight experienced by the user and hence aid the user movement or provide more resistance to the user movement. This means that at different points of the first motion and the second motion the resistance to the user action may vary as it does with an asymmetric cam.

In embodiments of the present invention that use sensors to monitor the movement of the pulleys or the amount of cable in the system, the sensors may be RFID tags or other sensing means. In some embodiments, the RFID tags may comprise a sensor located adjacent to the first pulley 12, 22 (or in the case of the embodiments known from FIGS. 3, 4, 5, 6 the third pulley 42, 62, 92, 122) and the cable 11, 21, 41, 91 (or in the embodiments known from FIGS. 4, 6 the first cable 61, 121) may have markings at regular intervals along the cable. The sensor may monitor how quickly the markings move past the sensor and, in combination with information that describes the distance between the markings on the cable, may calculate how much cable has passed the sensor and hence how much cable is in the system and the RFID tag may communicate this to the winch 18, 28, 48, 80, 99, 132. In other embodiments, a rotational encoder may be attached to the RFID tag and the sensor may directly monitor the rotation of the first pulley 12, 22 (or in the case of the embodiments known from FIGS. 3, 4, 5, 6 the third pulley 42, 62, 92, 122) or any other pulley in the system. The sensor may further comprise a processor and a memory and perform calculations as to how much cable is in the system, taking either the information regarding how much cable has passed the sensor or how may rotations the first pulley 12, 22 (or in the case of the embodiments known from FIGS. 3, 4, 5, 6 the third pulley 42, 62, 92, 122) has gone through and the sensor may perform these calculations locally. Alternatively, the sensor may simply communicate how quickly the markings pass the sensor to a remote processor and memory and the calculation may be performed remotely.

The sensors may further comprise a strain gauge. In the embodiment shown in FIG. 1, the strain gauge could be located between the weight stack 14, 24, 44, 76, 94, 128 and the second pulley 13, 23 (or in the case of the embodiments known from FIGS. 3, 4, 5, 6 the third pulley 42, 62, 92, 122). The strain gauge would measure the downward force exerted on the strain gauge by the weight stack 14, 24, 44, 76, 94, 128 and this information may be communicated to the control unit such that the control unit can take into account the mass of the weight stack 14, 24, 44, 76, 94, 128 that the user is lifting. In some embodiments, such an arrangement may also be used to warn the user if no weights have been selected on the weight stack 14, 24, 44, 76, 94, 128 or if the pin securing the weights is missing.

The RFID tags may have unique identification codes such that the control unit can identify which RFID it is communicating with. The RFID tag or any other sensor may be powered by harvesting energy from the user movements or from an external energy source. The sensors may be battery powered in other embodiments. In some embodiments, the sensors may be powered by mains electricity.

In some embodiments of the present invention, the winch 18, 28, 48, 80, 99, 132 only operates when the user is stationary, in other embodiments, the operation of the winch 18, 28, 48, 80, 99, 132 may be in a step-wise manner. In other embodiments of the present invention, the winch 18, 28, 48, 80, 99, 132 operates whilst the user is performing the first or second mode of operation, and this operation may be in a continuous manner.

The weight stack 14, 24, 44, 76, 94, 128 may, as discussed above, comprise a single mass, which cannot be changed by the user. The weight stack 14, 24, 44, 76, 94, 128 may comprise a number of masses, which the user can select in order to vary the internal force. The advantage of using the weight stack 14, 24, 44, 76, 94, 128 is that it provides an experience that a user may be familiar with, for example when compared to free weights, a standard cable machine or a standard body-part machine. The weight stack 14, 24, 44, 76, 94, 128 and second pulley 13, 23 (or in the case of the embodiments known from FIGS. 3 and 5 the fourth pulley 43, 93 or in the case of the embodiment known from FIG. 4, the eighth pulley 73) may be replaced by a rotor in an electromagnetic field in some embodiments of the present invention. In other embodiments of the present invention, the weight stack 14, 24, 76, 94, 128 and second pulley 13, 23 (or in the case of the embodiments known from FIGS. 3, 5 the fourth pulley 43, 93 or in the case of the embodiment known from FIG. 4, the eighth pulley 73) may be replaced by an elastic object, and the internal force is produced by deforming the elastic object. Other methods for producing an internal force are contemplated. An advantage of using a rotor in an electromagnetic field to produce the internal force, is that the exercise machine may weigh less and be easier to move. An advantage of using an elastic object to produce the internal force is that an elastic object may be light, cheap to produce and easy to replace.

Any of the cables 11, 21, 41, 91 (or in the embodiment known from FIG. 4, the first and second cables 61, 79 or in the embodiment known from FIG. 6 the first, second and third cables 121, 127, 131) may be replaced by a belt in some embodiments of the present invention. In other embodiments, a Kevlar reinforced cable or belt may be used. In further embodiments, a belt reinforced by metal wires may be used. An advantage of using a belt over a cable is that the load is spread more evenly over each individual pulley, potentially lengthening the life of the pulleys in the exercise equipment.

The winch 18, 28, 48, 80, 99, 132 may take the form of a motorised spool in some embodiments of the present invention. In other embodiments, a linear actuator may be used. In the exercise machine 10 shown in FIG. 1, a linear actuator could replace the winch 18 and the cable 32 and be attached directly to the fifth pulley 17. In the embodiment known from FIG. 1, a linear actuator could have a similar effect to the winch 18 it is replacing and will move the fifth pulley 17, such that the amount of cable between the third pulley 15 and the handle 110 is increased or decreased as required.

In the exercise machine 20 shown in FIG. 2, a linear actuator could replace the winch 28 and be attached to the cable 21. In the embodiment known from FIG. 2, the linear actuator will have a similar effect to the winch 28 it is replacing and will increase and decrease the amount of cable between the third pulley 25 and the handle 210.

In the exercise machine 40 shown in FIG. 3, a linear actuator could replace the winch 48 and be attached to the cable 52 and be attached directly to the seventh pulley 47. In the embodiment known from FIG. 3, a linear actuator could have a similar effect to the winch 48 it is replacing and will move the seventh pulley 47, such that the amount of cable between the fifth pulley 45 and the handle 410 is increased or decreased as required.

In the exercise machine 60 shown in FIG. 4, a linear actuator could replace the winch 80 and be attached to the second cable 79. In the embodiment known from FIG. 4, the linear actuator will have a similar effect to the winch 80 it is replacing and will increase and decrease the length of the second cable 79 between the eleventh pulley 78 and the attachment point 72.

In the exercise machine 90 shown in FIG. 5, a linear actuator could replace the winch 99 and be attached to the cable 91. In the embodiment known from FIG. 5, the linear actuator will have a similar effect to the winch 99 it is replacing and will increase and decrease the length of the cable 91 between the eighth pulley 98 and the handle 910.

In the exercise machine 120 shown in FIG. 6, a linear actuator could replace the winch 132 and be attached to the third cable 131. In the embodiment known from FIG. 6, the linear actuator will have a similar effect to the winch 132 it is replacing and will increase and decrease the length of the third cable 131 between the fifth pulley 130 and the second reel 124.

The advantage of using a motorised spool or a linear actuator is that they are different sizes and have different power to weight ratios than the winch 18, 28, 48, 80, 99, 132. This allows the exercise machine 10, 20, 40, 60, 90, 120 to be customised for the location in which it will be operated.

In some embodiments, the winch 18, 28, 48, 80, 99, 132 may include the control unit. The control unit may be communicatively coupled with a sensor or a plurality of sensors through wired or wireless means. In other embodiments of the present invention, the control unit that may communicate with external devices such as such as a smart phone, table device, smart watch, smart wristband, activity tracker or other devices. The data received by the control unit may be from sensors on one or more of the pulleys 12, 13, 15, 16, 17, 22, 23, 25, 42, 43, 45, 46, 47, 53, 54, 55, 58, 59, 62, 63, 64, 65, 66, 68, 69, 73, 74, 77, 78, 92, 93, 95, 96, 97, 98, 101, 102, 122, 129, 130, 135, 136. This data may comprise information about the movement of the pulleys 12, 13, 15, 16, 17, 22, 23, 25, 42, 43, 45, 46, 47, 53, 54, 55, 58, 59, 62, 63, 64, 65, 66, 68, 69, 73, 74, 77, 78, 92, 93, 95, 96, 97, 98, 101, 102, 122, 129, 130, 135, 136. Other embodiments of the present invention may include a sensor on the weight stack 14, 24, 44, 76, 94, 128 and communicate to the control unit information about the internal force. Some embodiments may include sensors on the handle 110, 210, 410, 610, 910, 1010, which communicate with the control unit. The data collected from the handle 110, 210, 410, 610, 910, 1010 may include heart rate information. Other embodiments of the present information may collect information from the handle 110, 210, 410, 610, 910, 1010 that indicates a hazardous situation, for example if the user has released the handle 110, 210, 410, 610, 910, 1010 whilst performing the first or second motions.

The control unit may comprise a microprocessor, RAM and a memory. The control unit may receive data from any of the sensors and store it in the memory. The control unit may retrieve data from the memory and perform calculations on the data. The output of calculations performed by the control unit may be used by the control unit to calculate whether a user is performing a first motion or a second motion. The control unit may calculate whether a user is performing a first motion or in the second motion.

The control unit may be communicatively coupled to a display device. This display device may display may display how many repetitions a user has performed, the heart rate of a user, a user calorie count or any other information that a user may require. The display device may be a touchscreen device and a user may be able to input information that is used by the control unit, for example a user weight or a user age. The user might input information about the internal force such that the user does not need to directly interact with the weight stack 14, 24, 44, 76, 94, 128. In other embodiments, the control unit may be communicatively coupled with an external device such as a smart phone, table device, smart watch, smart wristband, activity tracker or other device. The user may be able to input information through an external device. The control unit may store information that a user has input in the memory. The control unit may retrieve the information that a user has input from the memory and perform calculations on it.

In some embodiments, the control unit may be able to track users through the use of a unique identification code. This may be a code that is input by a user through the display device or through an external device. Alternatively the external device may automatically provide the unique identification code, for example through the MAC address of the device, by storing a code after it has been input by a user or through other paring means.

The control unit of the present invention may be connected to a local network or a wider network such as the internet in order to upload information about users to a central server or through a distributed network. This information may be accessed by the user through different external devices and from a location that is different to that of the present invention. This information may be accessed by other exercise machines in the same location as the present invention or may be accessed by exercise machines in a different location to the present invention. The exercise machine 10, 20, 40, 60, 90, 120 may access such information in order to calculate the user force to impart to the user.

In other embodiments of the present invention, a system for tracking the user's movements in real time is not required. The cable may be introduced between the entry point and the member at a constant rate, when the user starts the first or second motion, in order to reduce the effective weight experienced by the user. The cable may continue to be introduced between the entry point and the member throughout the duration of the user performing the first or the second motion. Such an embodiment may require a system for detecting when the user starts or finishes the first and second motions or the user may indicate that they are about to start or finish the first or second motion through the use of a switch, voice recognition or eye movement sensors. The embodiment may also detect that a certain amount of cable has been introduced between the entry point and the member in order to establish when the user has finished the first or the second motion. The cable may alternatively be introduced between the entry point and the member at, for example, a first rate and a second rate. The change between the first rate and the second rate may be based on an amount of cable passing the entry point or the user indicating that they wish the rate to change.

Another embodiment of the present invention may be applied to an elevator/lift mechanism, as shown in FIG. 8. FIG. 8 comprises an elevator mechanism 750. The elevator mechanism 750 comprises a weight 709, a first cable 710, a second cable 706, a first pulley 708, a second pulley 705, a third pulley 704, a first member 707, a second member 703, a winch 702 and an elevator car 701. These components are arranged in a lift shaft (not shown). The first cable 710 has a distal end attached to a weight 709. The first cable 710 passes upwards from the weight 709 to pass over the first pulley 708, which is preferably arranged at the top of the lift shaft. The first pulley 708 is vertically orientated and is rotatable about a first axis. A motor (not shown) powers the first pulley 708. The first pulley 708 is grooved, such that it may grip the first cable 710 and move the first cable. The first cable 710 extends downwards from the first pulley 708 and the proximal end of the first cable 710 is attached to a first attachment point 711 at a distal end of the first member 707.

Attached towards the proximal end of the first member 707 is a second pulley 705. At the proximal end of the first member 707 is a second attachment point 712. The first member 707 and the second pulley 705 may comprise a first unit, so that these components are fixed to each other and the distance between them does not vary. The first unit is vertically orientated and can move in both directions along a first, generally vertical linear axis. The first unit may be arranged to move along a vertical track (not shown), for example, to allow this motion to take place.

A third pulley 704, a second member 703 and an elevator car 701 comprise a second unit, so that these components are fixed to each other and the distance between them does not vary. The third pulley 704 is attached near to the distal end of the second member 703. The proximal end of the second member 703 is generally attached to the roof of the elevator car 701. The second unit is vertically orientated and can move in both directions along a second, generally vertically linear axis. The second unit may be arranged to move along a vertical track (not shown), for example, to allow this motion to take place. The second unit is generally arranged vertically below the first unit.

A second cable 706 is attached at a distal end to the second attachment point 712. The second cable 706 extends downwards from the second attachment point 712 and under the third pulley 704. The third pulley 704 is vertically orientated and is rotatable about a third axis. The second cable 706 extends upwards from the third pulley 704 to pass over the second pulley 705. The second pulley 705 is vertically orientated and is rotatable about a second axis. The second cable 706 extends downwards from the second pulley 705 and is attached at a proximal end to a winch 702. The winch 702 is attached to the roof of the elevator car 701. The winch 702 may be operated to rotate a drum (not shown) around which the second cable 706 is wound. The winch 702 may therefore increase or decrease the length of the second cable 706 that extends from the winch 702.

The second cable 706 is continuously threaded around the third pulley 704, over the second pulley 705 and into the winch 702.

In some embodiments, the first pulley 708 is a grooved drive sheave.

In use, the winch 702 may be either in a locked mode or in an unlocked mode.

If the winch 702 is in the locked mode, then when the motorised first pulley 708 rotates in a first rotational direction, the counterweight 709 rises and the elevator car 701 is lowered. When the motorised first pulley 708 rotates in a second, opposite rotational direction, the counterweight 709 is lowered and the elevator car 701 is raised. Each rotation of the motorised first pulley 708 raises and lowers both the elevator car 701 and the counterweight 709 by a fixed amount.

If the winch 702 is in the unlocked mode, the length of the second cable 706 between the second attachment point 712 and the winch 702 may be increased or decreased as the elevator car 701 rises and lowers due to the movement of the motorised winch 708. This will cause the elevator car 701 to move at a different rate to the counterweight 709.

The advantage of such an arrangement is that the inertia imparted to the elevator car 701 can be varied. For example, when approaching a stopping point, in order to ensure the comfort of the users, it is preferable to impart a small amount of inertia to the elevator car 701. However, in order to rapidly move the elevator car 701 up and down a lift shaft, a high amount of inertia is preferable. In order to balance these competing requirements, the winch 702 can increase or decrease the amount of second cable 706 as the elevator car 701 is moving.

In use, the elevator mechanism 750 may incorporate a first pulley 708 with a large inertia in order to move the elevator car 701 rapidly. However, when the elevator car 701 is approaching a stopping point, for example at a requested floor, a system with a low inertia is required. When the car is approaching a stopping point, the winch 702 may adjust the length of the second cable 706 in-between the winch 702 and the second attachment point 712. By shortening or lengthening the length of the second cable 706, the elevator mechanism 750 can make use of a low inertia system in order to make small adjustments to the position of the elevator car 701.

In use, as the elevator mechanism 750 moves the elevator car 701 from a lower floor to a higher floor, the length of the first cable 710 between the first pulley 708 and the elevator car 701 is shortened. At the same time, as the elevator car 701 begins to move from the lower floor, the elevator mechanism 750 may lengthen the length of the second cable 706 in-between the winch 702 and the second attachment point 712 in order to reduce the acceleration experienced within the elevator car 701.

As the elevator car 701 moves up the lift shaft, the elevator mechanism 750 may reduce the length of the second cable 706 in-between the winch 702 and the second attachment point 712.

As the elevator car 701 approaches the higher floor, the elevator mechanism 750 may lengthen the length of the second cable 706 in-between the winch 702 and the second attachment point 712 in order to reduce the deceleration experienced within the elevator car 701.

In a first mode of operation, the winch 702 may be set to a locked position by a control mechanism. In this mode of operation, the elevator car 701 moves at the same rate, but in the opposite direction to, the counterweight 709, both of which are dependent on the rate of rotation of the first pulley 708.

In a second mode of operation, the winch 702 may vary the length of the second cable 706 in-between the winch 702 and the second attachment point 712. In this manner, the elevator car 701 moves at a different rate to the counterweight 709 and the rate of movement of the elevator car 701 is not solely dependent on the rate of rotation of the first pulley 708.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A system for imparting a variable user force to a user, the system comprising:

a line guide arrangement, including at least one moveable line guide which may move in both directions along a linear axis;

wherein a force arrangement is arranged to apply at least one internal force to the at least one moveable line guide, wherein the at least one internal force opposes the motion of the at least one moveable line guide in a first direction along the linear axis;

a member with which the user may interact so that the user force is applied to the user through the member;

a line, having a distal end and a proximal end, with the distal end of the line attached to the member, the line being continuously threaded around the line guide arrangement;

the system further comprising a line adjustment arrangement, wherein:

the line adjustment arrangement is attached to the line, or is connected to move a component of the line guide arrangement;

when the line adjustment arrangement is in a locked mode, there is a first ratio between distance moved by the member and distance moved by the force arrangement;

the line adjustment arrangement is operable to remove/introduce line between an entry point and the member, or actively move the component of the line guide arrangement, to alter the ratio between distance moved by the member and distance moved by the force arrangement during movement of the member, wherein:

the system is configured to apply a first mode of operation during a first motion performed by the user and a second mode of operation during a second motion performed by the user, wherein the line adjustment arrangement changes the length of line between the entry point and the member in a different manner during the first and second modes of operation; and wherein the line adjustment arrangement is operable to apply a scaling factor to the distance moved by the member in order to remove or introduce line between the entry point and the member at a rate which is, at any moment, maintained in a pre-determined proportion to the rate at which the user moves the member.

2. The system of claim 1, such that the user force is proportional to the internal force and the user force may be varied by manipulating the line adjustment arrangement.

3. The system of claim 1, wherein the first or second mode of operation is such that the first or second motion may be performed without any active change in the length of the line between the entry point and the member being applied by the line adjustment arrangement.

4. The system of claim 1, wherein the system is configured to apply a third mode of operation when the member is stationary between the first and second motions, wherein the line adjustment arrangement changes the length of line between the entry point and the member.

5. The system of claim 4, wherein the third mode is configured such that, following the first and the second motions, the length of line in the system is the same as before the first motion.

6. The system of claim 1, wherein the system is configured to apply a fourth mode of operation when the member is stationary between the second motion and a further first motion, wherein the line adjustment arrangement changes the length of line between the entry point and the member.

7. The system of claim 6, wherein the fourth mode is configured such that, following the first and the second motions, the length of line in the system is the same as before the first motion.

8. The system of claim 1, wherein the line adjustment arrangement is able to adjust the length of the line in the system in a continuous manner, or wherein the line adjustment arrangement is able to adjust the length of the line in the system in a step-wise manner.

9. The system of claim 8 wherein, in use, the internal force is applied by a mass within a gravitational field, or in use, the internal force is applied by a rotor in an electromagnetic field, or in use, the internal force is applied by the deformation of an elastic object.

10. The system of claim 9, wherein the line is a cable, or wherein the line is a belt.

11. The system of claim 10, wherein the line adjustment arrangement comprises a motorised spool or a winch, or wherein the line adjustment arrangement comprises a linear actuator.

12. The system of claim 11, wherein the line adjustment arrangement can be manipulated by the user, a third party, or both the user and the third party to change the length of line between the entry point and the member.

13. The system of claim 12, wherein the line adjustment arrangement can be manipulated through voice recognition to change the length of line between the entry point and the member.

14. The system of claim 13 further comprising a measurement arrangement to measure movement of the member.

15. The system of claim 14, wherein the manipulation of the line adjustment arrangement is automated by a real-time system, the real-time system able to process at least the user force, the internal force and the length of line between the entry point and the member using a microprocessor, or wherein the manipulation of the line adjustment arrangement is automated by a real-time system, the real-time system able to process at least the user force, the internal force and the length line between the entry point and the member by mechanical means.

16. The system of claim 12, wherein the line adjustment arrangement can be manipulated with a switch to change the length of line between the entry point and the member.

17. The system of claim 12, wherein the line adjustment arrangement can be manipulated through eye movement recognition to change the length of line between the entry point and the member.

18. The system of claim 1 wherein the line adjustment arrangement is operable to change the mode of operation during a first or second user operation so that the ratio between distance moved by the member and distance moved by the force arrangement during movement of the member is not constant during the first or second user motion.

19. The system of claim 1, wherein (a) the system is configured to apply a third mode of operation when the member is stationary between the first and second motions, wherein the line adjustment arrangement changes the length of line between the entry point and the member;

(b) the system is configured to apply a fourth mode of operation when the member is stationary between the second motion and a further first motion, wherein the line adjustment arrangement changes the length of line between the entry point and the member; and (c) the third and/or fourth modes are configured such that, following the first and the second motions, the length of line in the system is the same as before the first motion.

* * * * *